US010286665B2

(12) United States Patent
Horiuchi et al.

(10) Patent No.: US 10,286,665 B2
(45) Date of Patent: May 14, 2019

(54) LIQUID EJECTION HEAD AND RECORDING DEVICE USING SAME

(71) Applicant: KYOCERA Corporation, Kyoto-shi, Kyoto (JP)

(72) Inventors: Kousei Horiuchi, Kyoto (JP); Kouichi Maruta, Kyoto (JP); Kazumasa Furuhashi, Kyoto (JP); Yoshihiro Yuu, Kyoto (JP); Ayumu Matsumoto, Kyoto (JP); Hiroshi Tamura, Kyoto (JP); Takayuki Yamamoto, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/748,921

(22) PCT Filed: Jul. 28, 2016

(86) PCT No.: PCT/JP2016/072168
§ 371 (c)(1),
(2) Date: Jan. 30, 2018

(87) PCT Pub. No.: WO2017/018484
PCT Pub. Date: Feb. 2, 2017

(65) Prior Publication Data

US 2019/0001673 A1 Jan. 3, 2019

(30) Foreign Application Priority Data

Jul. 30, 2015 (JP) ..... 2015-150912
Jul. 30, 2015 (JP) ..... 2015-150913
Aug. 27, 2015 (JP) ..... 2015-167907

(51) Int. Cl.
*B41J 2/14* (2006.01)
*B41J 2/155* (2006.01)

(52) U.S. Cl.
CPC ..... *B41J 2/1433* (2013.01); *B41J 2/14209* (2013.01); *B41J 2/14233* (2013.01);
(Continued)

(58) Field of Classification Search
CPC .. B41J 2/1433; B41J 2/14209; B41J 2/14233; B41J 2/155
See application file for complete search history.

(56) References Cited

U.S. PATENT DOCUMENTS

2007/0171260 A1* 7/2007 Lee ..... B41J 2/14233 347/71
2010/0165057 A1* 7/2010 Morita ..... B41J 2/14209 347/68
2010/0220152 A1* 9/2010 Hayashi ..... B41J 2/14209 347/56

FOREIGN PATENT DOCUMENTS

JP 2010-155416 A 7/2010
JP 2012-011629 A 1/2012
(Continued)

OTHER PUBLICATIONS

International Search Report, PCT/JP2016/072168, dated Oct. 11, 2016, 1 pg.

*Primary Examiner* — Jason S Uhlenhake
(74) *Attorney, Agent, or Firm* — Volpe and Koenig, P.C.

(57) ABSTRACT

A liquid ejection head includes a first channel member and a plurality of pressurizing parts. The first channel member includes a plurality of ejection holes, a common channel, a damper chamber, and a damper. The first channel member is configured by a plurality of flat plates including a first plate with the plurality of ejection holes and a second plate adjacent to this. The second plate includes a first part sandwiched between the damper chamber and the first plate. A covering layer is unevenly provided on the first surface of the first part.

15 Claims, 12 Drawing Sheets

(52) U.S. Cl.
CPC ..... *B41J 2/155* (2013.01); *B41J 2002/14217* (2013.01); *B41J 2002/14225* (2013.01); *B41J 2002/14306* (2013.01); *B41J 2002/14419* (2013.01); *B41J 2002/14459* (2013.01); *B41J 2202/11* (2013.01); *B41J 2202/12* (2013.01); *B41J 2202/21* (2013.01)

(56) References Cited

FOREIGN PATENT DOCUMENTS

| | | | |
|---|---|---|---|
| JP | 2012-025117 | A | 2/2012 |
| JP | 2012-192641 | A | 10/2012 |

* cited by examiner

LIQUID EJECTION HEAD AND RECORDING DEVICE USING SAME

TECHNICAL FIELD

The present disclosure relates to a liquid ejection head and a recording device using the same.

BACKGROUND ART

Conventionally, as a printing head, for example there is known a liquid ejection head performing printing by ejecting liquid onto a recording medium. As such a liquid ejection head, for example there is known one provided with a plurality of ejection holes ejecting a liquid, a plurality of pressurizing chambers corresponding to the plurality of ejection holes and pressurizing the liquid so that the liquid is ejected from the ejection holes, and a common channel which supplies the liquid to the plurality of pressurizing chambers (for example, see Patent Literature 1).

CITATION LIST

Patent Literature

Patent Literature 1: Japanese Patent Publication No. 2012-11629

SUMMARY OF INVENTION

A liquid ejection head of the present disclosure includes a channel member and a plurality of pressurizing parts. The channel member includes a plurality of ejection holes, a common channel, a damper chamber, and a damper. The plurality of ejection holes are holes ejecting a liquid. The common channel is linked with the plurality of ejection holes. The damper chamber is configured by a space outside of the common channel. The damper is configured by a wall partitioning the common channel and the damper chamber. The plurality of pressurizing parts pressurize the liquid. The channel member is configured by a stacked plurality of flat plates. The plurality of plates include a first plate with the plurality of ejection holes and a second plate adjacent to the first plate. The second plate includes a first part sandwiched between the first plate and the damper chamber. The first part includes a first surface on the opposite side to the first plate. The liquid ejection head includes a covering layer which is unevenly provided on the first surface of the first part.

DESCRIPTION OF EMBODIMENTS

The inventors confirmed that, when a liquid ejection head as disclosed in Patent Literature 1 is being driven, a very small vibration having an amplitude of about 2 to 3 μm is generated on the surface in which the ejection holes are formed. Such vibration may degrade the ejection characteristics of the liquid. Further, if such vibration becomes greater, it is guessed that the ejection characteristics of the liquid would be further degraded.

A liquid ejection head of the present disclosure can reduce generation of large vibration on the surface in which the ejection holes are formed. In the following description, a detailed explanation will be given of a liquid ejection head of the present disclosure and a recording device using the same.

First Embodiment

Figure 1A:
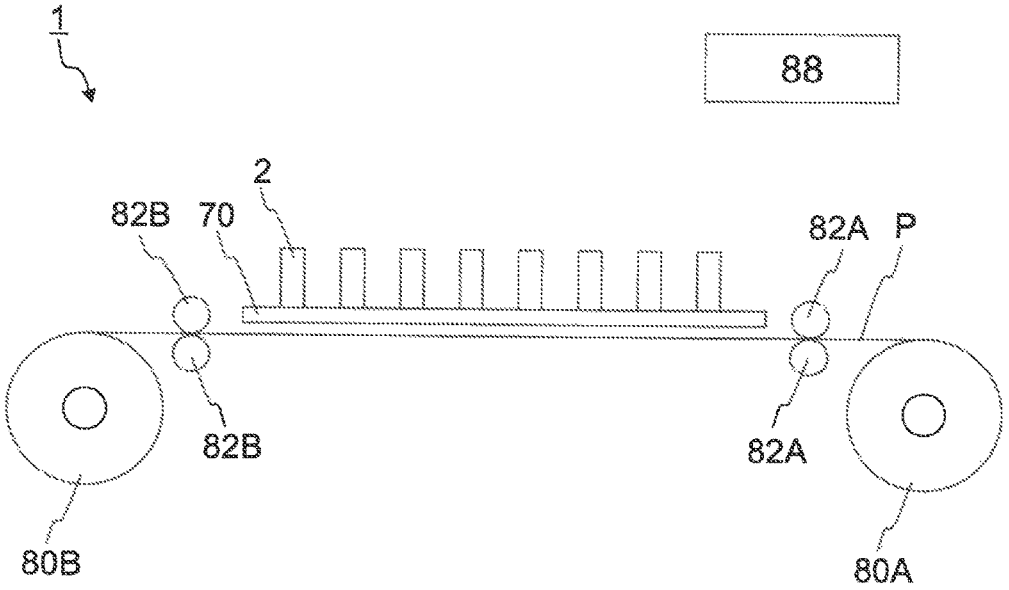
FIG. 1A is a side view of a recording device including a liquid ejection head according to a first embodiment.
Figure 1B:
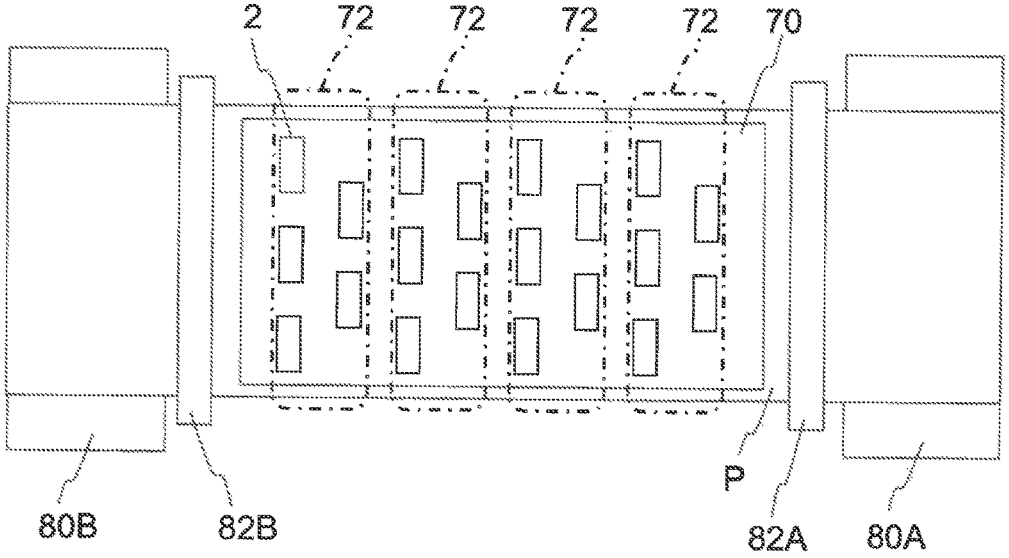
FIG. 1B is a plan view of a recording device including a liquid ejection head according to the first embodiment.

FIG. 1A is a schematic side view of a recording device including liquid ejection heads 2 according to a first embodiment constituted by a color inkjet printer 1 (below, sometimes simply referred to as a "printer"), and FIG. 1B is a schematic plan view. The printer 1 conveys a recording medium of the printing paper P from a paper feed roller 80A to a collection roller 80B to make the printing paper P move relative to the liquid ejection heads 2. A control part 88 controls the liquid ejection heads 2 based on image or text data to make them eject liquid toward the printing paper P and shoot droplets onto the printing paper P to thereby perform recording such as printing on the printing paper P.

In the present embodiment, the liquid ejection heads 2 are fixed with respect to the printer 1, so the printer 1 becomes a so-called line printer, but the structure is not limited to this. For example, it may also be a so-called serial printer which alternately performs an operation of moving the liquid ejection heads 2 to reciprocate or the like in a direction crossing the conveying direction of the printing paper P, for example, a substantially perpendicular direction, and conveyance of the printing paper P.

To the printer 1, a plate-shaped head mounting frame 70 (below, sometimes simply referred to as a "frame") is fixed so that it becomes substantially parallel to the printing paper P. The frame 70 is provided with not shown 20 holes. Twenty liquid ejection heads 2 are mounted in the hole portions. The portions of the liquid ejection heads 2 which eject the liquid face the printing paper P. A distance between the liquid ejection heads 2 and the printing paper P is set to for example about 0.5 to 20 mm. Five liquid ejection heads 2 configure one head group 72. The printer 1 has four head groups 72.

A liquid ejection head 2 has a long shaped elongated in a direction from the front to the inside in FIG. 1A and in the up-down direction in FIG. 1B. This long direction will be sometimes called as the "longitudinal direction". In one head group 72, three liquid ejection heads 2 are aligned in a direction crossing the conveying direction of the printing paper P, for example, a substantially perpendicular direction. The other two liquid ejection heads 2 are aligned at positions offset along the conveying direction so that each is arranged between two among the three liquid ejection heads 2. The liquid ejection heads 2 are arranged so that ranges which can be printed by the liquid ejection heads 2 are connected in the width direction of the printing paper P (in the direction crossing the conveying direction of the printing paper P) or the ends overlap each other, therefore printing without a gap becomes possible in the width direction of the recording medium P.

The four head groups 72 are arranged along the conveying direction of the printing paper P. To each liquid ejection head 2, a liquid, for example, ink, is supplied from a not shown liquid tank. To the liquid ejection heads 2 belonging to one head group 72, ink of the same color is supplied. Inks of four colors can be printed by the four head groups 72. The colors of inks ejected from the head groups 72 are for example magenta (M), yellow (Y), cyan (C), and black (K). If printing such inks is carried out by controlling by the control part 88, color images can be printed.

The number of liquid ejection heads 2 mounted in the printer 1 may be one as well so far as printing is carried out for a range which can be printed by one liquid ejection head 2 in a single color. The number of liquid ejection heads 2 included in the head group 72 or the number of head groups 72 can be suitably changed according to the target of printing or printing conditions. For example, the number of head groups 72 may be increased as well in order to perform printing by further multiple colors. Further, if a plurality of head groups 72 for printing in the same color are arranged and printing is alternately carried out in the conveying direction, the conveying speed can be made faster even if liquid ejection heads 2 having the same performances are used. Due to this, the printing area per time can be made larger. Further, it is also possible to raise the resolution in the width direction of the printing paper P by preparing a plurality of head groups 2 for printing in the same color and arranging them offset in a direction crossing the conveying direction.

Further, other than printing colored inks, a coating agent or other liquid may be printed as well in order to treat the surface of the printing paper P.

The printer 1 performs printing on the recording medium of the printing paper P. The printing paper P is in a state wound around the paper feed roller 80A. After passing between the two guide rollers 82A, it passes under the liquid ejection heads 2 mounted in the frame 70. After that, it passes between the two conveying rollers 82B and is finally collected by the collection roller 80B. When printing, by rotating the conveying rollers 82B, the printing paper P is conveyed at a constant speed and is printed on by the liquid ejection heads 2. The collection roller 80B takes up the printing paper P fed out from the conveying rollers 82B. In this way, the paper feed roller 80A, guide rollers 82A, conveying rollers 82B, and collection roller 80B configure the conveying part which conveys the printing paper P with respect to the liquid ejection heads 2. The conveying speed is set to for example 50 m/min. Each roller may be controlled by the control part 88 or may be operated manually by a person.

The recording medium may be a roll of fabric or the like other than printing paper P. Further, the printer 1, in place of directly conveying the printing paper P, may directly convey a conveyor belt to convey the recording medium on the conveyor belt. When performing this, a sheet, cut fabric, wood, tile, etc. can be used as the recording medium. Further, a liquid containing conductive particles may be ejected from the liquid ejection heads 2 to print a wiring pattern etc. of an electronic apparatus as well. Furthermore, predetermined amounts of liquid chemical agents or liquids containing chemical agents may be ejected from the liquid ejection heads 2 toward a reaction vessel or the like to cause a reaction etc. and thereby prepare pharmaceutical products.

Figure 2A:
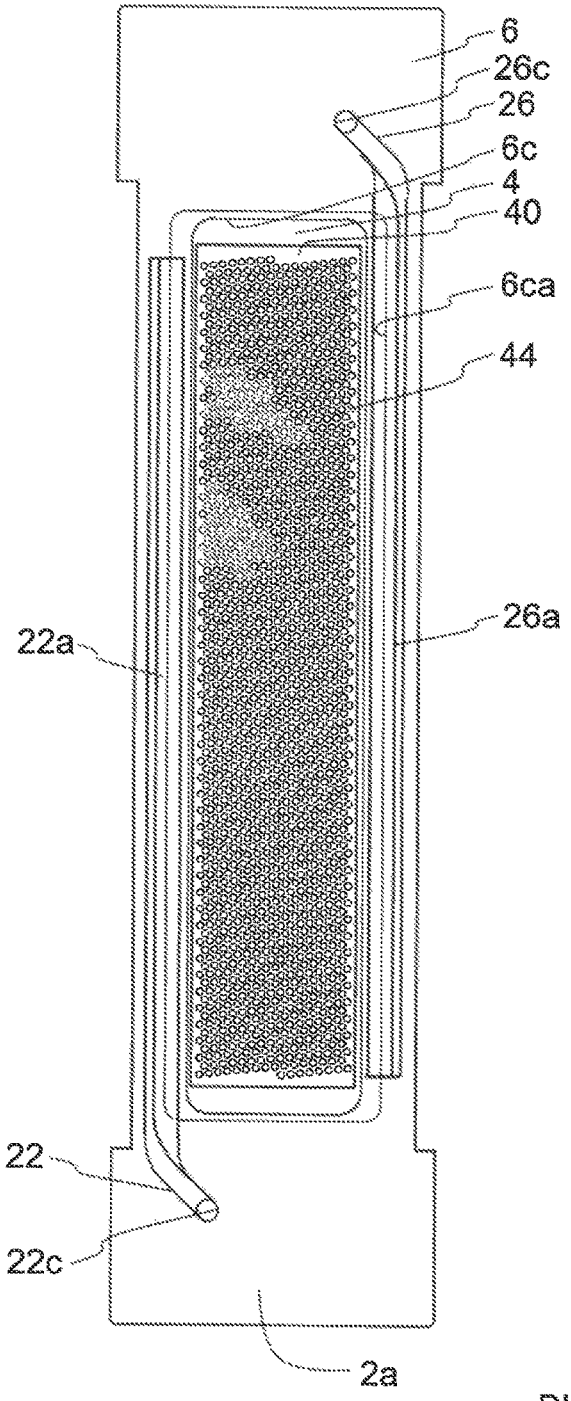
FIG. 2A is a plan view of a head body forming a principal part of the liquid ejection head in FIG. 1.
Figure 2B:
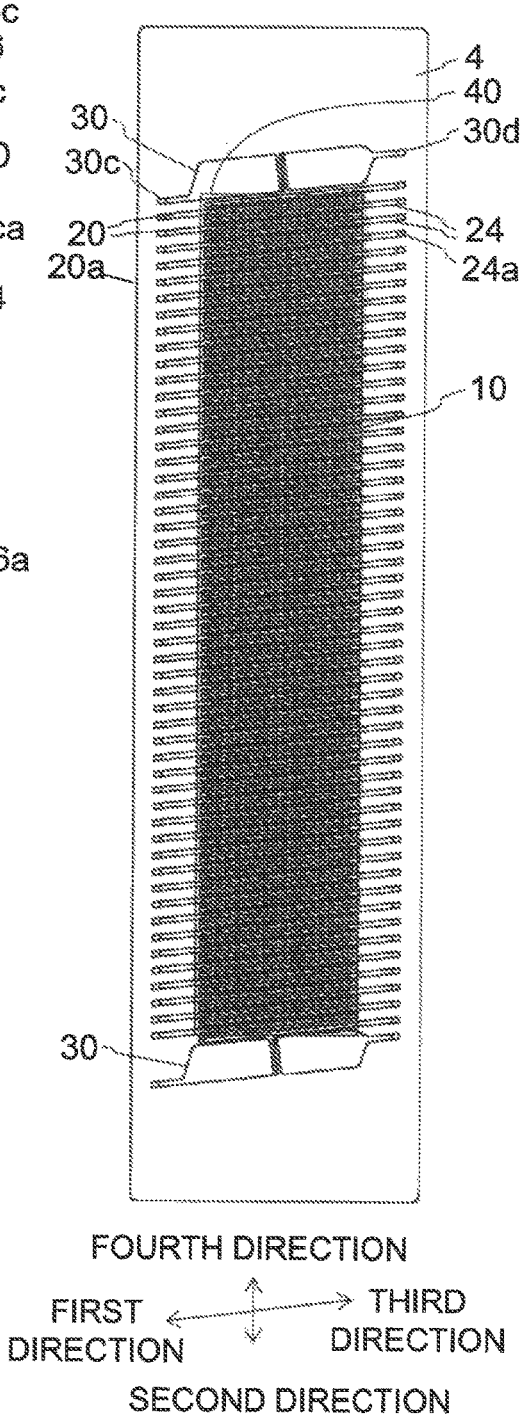
FIG. 2B is a plan view obtained by excluding a second channel member from FIG. 2A.
Figure 3:
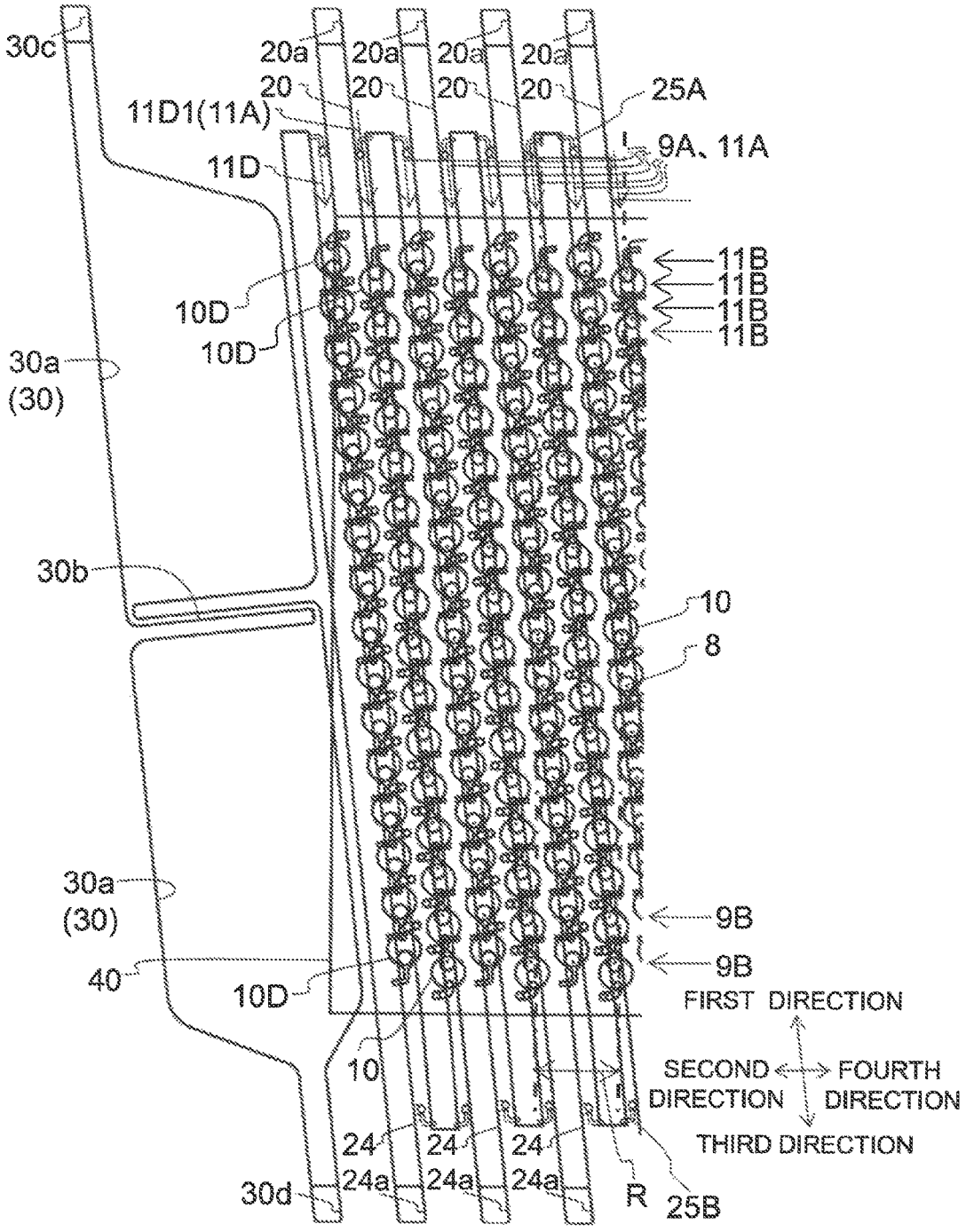
FIG. 3 is an enlarged plan view of a portion in FIG. 2B.
Figure 4:
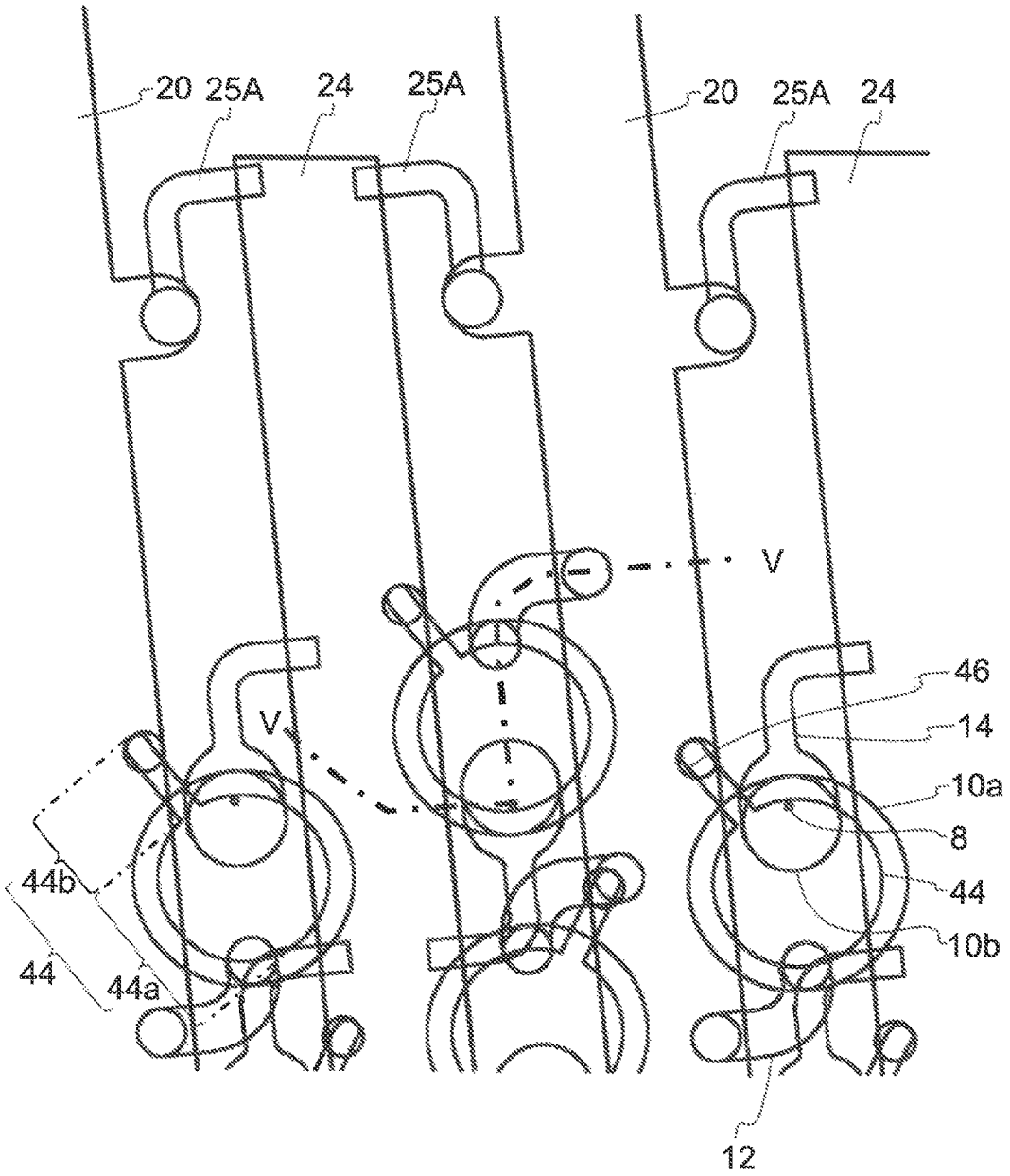
FIG. 4 is an enlarged plan view of a portion in FIG. 2B.
Figure 5:
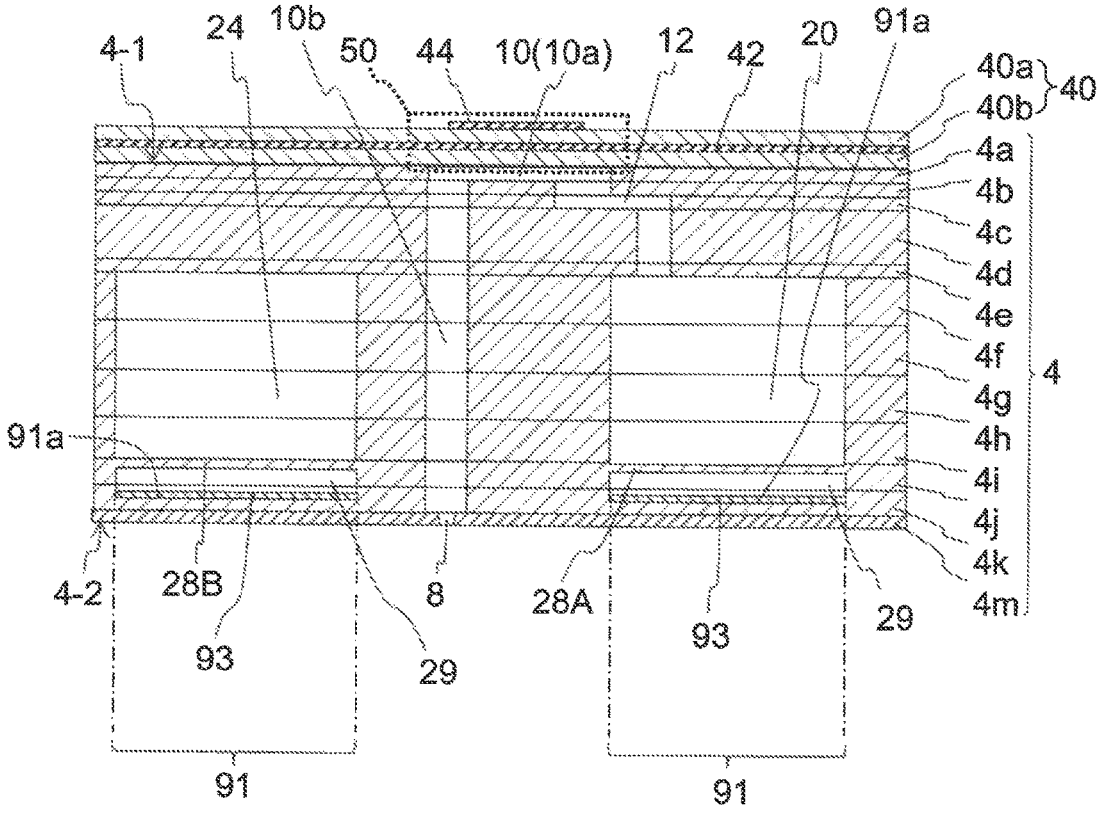
FIG. 5 is a partial vertical cross-sectional view along the V-V line in FIG. 4.
Figure 6:
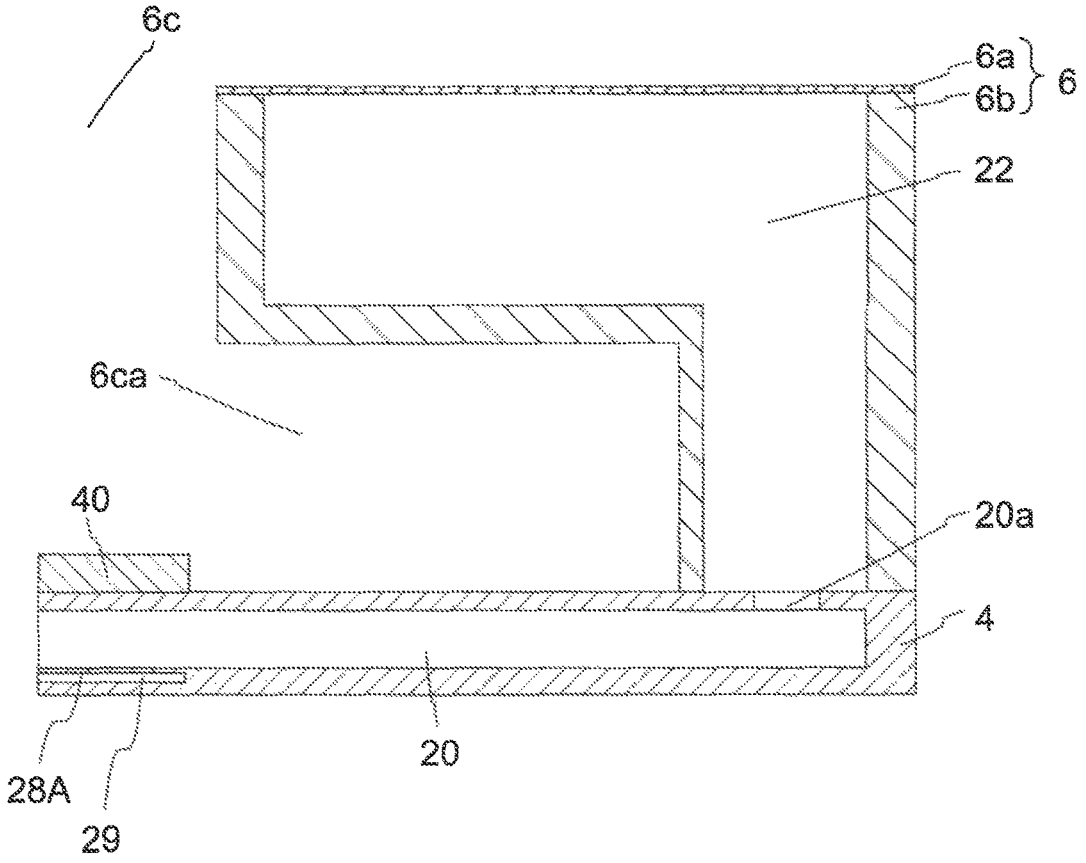
FIG. 6 is a partial vertical cross-sectional view of the head body in FIG. 2A.
Figure 7:
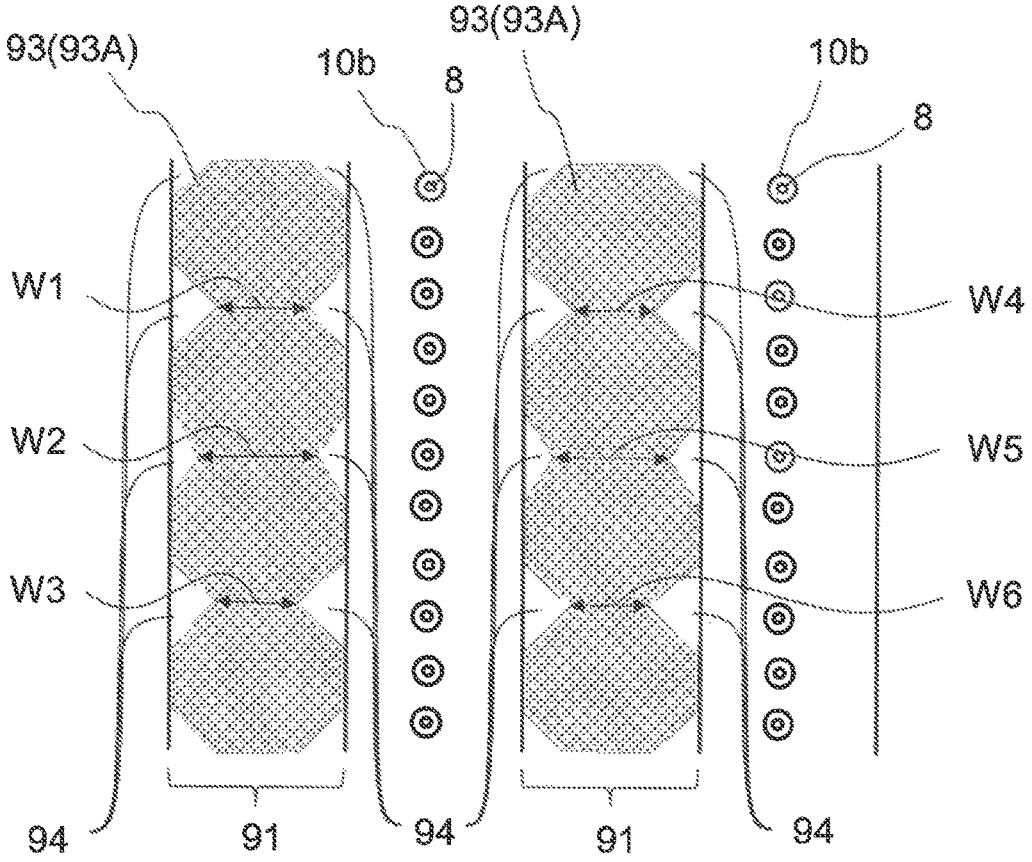
FIG. 7 is a schematic plan view showing a state when viewing a part in a second plate 4*k* configuring the liquid ejection head according to the first embodiment from the opposite side to a first plate 4*m*.

Next, a liquid ejection head 2 of the first embodiment will be explained. FIG. 2A is a plan view showing a head body 2*a* forming a principal part of the liquid ejection head 2 shown in FIGS. 1A and 1B. FIG. 2B is a plan view showing a state obtained by excluding the second channel member 6 from the head body 2*a*. FIG. 3 and FIG. 4 are enlarged plan views of FIG. 2B. FIG. 5 is a vertical cross-sectional view along the V-V line in FIG. 4. FIG. 6 is a partial vertical cross-sectional view along a first common channel 20 in the vicinity of an opening 20*a* of the first common channel 20 in the head body 2*a*. FIG. 7 is a schematic plan view showing a state where a portion of a second plate 4*k* configuring the liquid ejection head 2 according to the first embodiment is viewed from the opposite side to a first plate 4*m*.

The figures are drawn in the following way in order to facilitate understanding of the drawings. In FIGS. 2A and 2B to FIG. 4, channels etc. which are located below other and so should be drawn by broken lines are drawn by solid lines. In FIG. 2A, most of the channels in the first channel member 4 are omitted. Only the arrangement of individual electrodes 44 is shown.

The liquid ejection head 2, other than the head body 2*a*, may include a housing made of metal, a driver IC, circuit board, etc. Further, the head body 2*a* includes the first channel member 4, a second channel member 6 which supplies liquid to the first channel member 4, and a piezoelectric actuator substrate 40 having pressurizing parts 50. The head body 2*a* has a plate shape which is long in one direction. That direction will be sometimes referred to as the "longitudinal direction". Further, the second channel member 6 plays the role of a support member. The head body 2*a* is fixed at the two end parts in the longitudinal direction of the second channel member 6 to the frame 70.

The first channel member 4 configuring the head body 2*a* has a plate shape. Its thickness is about 0.5 to 2 mm. On the first surface of the first channel member 4, that is, the pressurizing chamber surface 4-1, a large number of pressurizing chambers 10 are arranged aligned in the surface direction. On the second surface of the first channel member 4 on the opposite side to the pressurizing chamber surface 4-1, that is, the ejection hole surface 4-2, a large number of ejection holes 8 ejecting liquid are arranged aligned in the surface direction. The ejection holes 8 are individually linked with the pressurizing chambers 10. Below, the explanation will be given assuming that the pressurizing chamber surface 4-1 is positioned above relative to the ejection hole surface 4-2.

In the first channel member 4, a plurality of first common channels 20 and a plurality of second common channels 24 are arranged so as to extend along the second direction.

Further, the first common channels 20 and the second common channels 24 are alternately aligned in the direction crossing the second direction, that is, the first direction. Note that, the second direction is the same direction as the longitudinal direction of the head body 2*a*.

The pressurizing chambers 10 are aligned along the two sides of each of the first common channels 20 and configure one column on each side, i.e., two pressurizing chamber columns 11A in total. The first common channels 20 and the pressurizing chambers 10 which are aligned on the two sides thereof are linked through the first individual channels 12.

The pressurizing chambers 10 are aligned along the two sides of each of the second common channels 24 and configure one column on each side, i.e., two pressurizing chamber columns 11A in total. The second common channels 24 and the pressurizing chambers 10 which are aligned on the two sides thereof are linked through the second individual channels 14. Note that, in the following description, sometimes the first common channels 20 and the second common channels 24 will be referred to as the "common channels" together.

Expressed another way, the pressurizing chambers 10 are arranged on imaginary lines. A first common channel 20 extends along one side of an imaginary line, and a second common channel 24 extends along the other side of the imaginary line. In the present embodiment, the imaginary lines on which the pressurizing chambers 10 are arranged are straight lines, but may be curved lines or bent lines as well.

Further, each first common channel 20 and the second common channel 24 are linked through a first connection channel 25A and second connection channel 25B (the two will be sometimes simply referred to together as the "connection channels") outside of the range where the pressurizing chambers are connected in the first direction. The first common channel 20 is connected to a plurality of first individual channels 12 in a certain range in the first direction to be connected through the plurality of first individual channels 12 to the plurality of pressurizing chambers 10. That range will be called the "individual channel connection region". The first common channel 20, outside of the individual channel connection region in the first direction, is linked through one first connection channel 25A with each of the second common channels 24 neighboring in the second direction. Further, the first common channel 20, outside of the third direction (direction opposite to the first direction) of the individual channel connection region, is linked through one second connection channel 25B with each of the second common channels 24 neighboring in the second direction. That is, with the first common channel 20, two first connection channels 25A are linked outside of the individual channel connection region in the first direction, and two second connection channels 25B are linked outside of the individual channel connection region in the third direction, i.e., four connection channels in total are linked.

In the first channel member 4 having the configuration as described above, the liquid supplied to the second common channels 24 flows into the pressurizing chambers 10 aligned along the second common channels 24. Further, part of the liquid is ejected from the ejection holes 8, while part of the liquid flows into the first common channels 20 positioned on opposite sides to the second common channels 24 relative to the pressurizing chambers 10 and is discharged to the outside of the first channel member 4. Further, part of the liquid does not pass through any pressurizing chamber 10 and flows from the second common channels 24 into the first common channels 20 through connection channels.

The channel resistances of the connection channels become larger than the first common channels 20 and second common channels 24. For this reason, the main flow of liquid becomes a flow passing through the pressurizing chambers 10. That is, the total of flow rate of the liquid which passes through the connection channels is half or less with respect to the flow rate through the parts having the largest flow rate in the first common channels 20. By doing this, the difference in the pressures applied to the menisci of the ejection holes 8 (below, sometimes simply referred to as the "pressure difference of menisci") can be made smaller.

The second common channels 24 are arranged on the two sides of each first common channel 20 and first common channels 20 are arranged on the two sides of each second common channel 24. Due to this, compared with a case where one first common channel 20 and one second common channel 24 are linked with respect to one pressurizing chamber column 11A and another first common channel 20 and another second common channel 24 are linked with respect to another pressurizing chamber column 11A, the number of first common channels 20 and second common channels 24 can be almost halved. By the amount of decrease of the number of first common channels 20 and second common channels 24, it is possible to increase the number of pressurizing chambers 10 to achieve a higher resolution, widen the first common channels 20 and second common channels 24 to make the difference of ejection characteristics from the ejection holes 8 smaller, and make the size in the surface direction of the head body 2*a* smaller.

The pressure which is applied to the portion of the first individual channel 12 on the first common channel 20 side which is linked with a first common channel 20 changes according to the position of linkage of the first individual channel 12 with the first common channel 20 (mainly the position in the first direction) due to an influence by pressure loss. The pressure applied to the portion of a second individual channel 14 on the second common channel 24 side which is linked with a second common channel 24 changes according to the position of linkage of the second individual channel 14 with the second common channel 24 (mainly the position in the first direction) due to the influence of pressure loss. If the openings 20*a* of the first common channels 20 to the outside are arranged at the end parts in the first direction and the openings 24*a* of the second common channels 24 to the outside are arranged at the end parts in the third direction, they act so as to cancel out the difference of pressures due to the arrangement of the first individual channels 12 and the second individual channels 14, therefore the difference of pressures applied to the ejection holes 8 can be made smaller. Note that, both of the openings 20*a* in the first common channels 20 and the openings 24*a* in the second common channels 24 open at the pressurizing chamber surface 4-1.

In a state where the liquid is not ejected, the menisci of the liquid are kept in the ejection holes 8. By the pressure of the liquid becoming a negative pressure in the ejection holes 8 (state of trying to draw liquid into the first channel member 4), the menisci can be retained by balance with the surface tension of the liquid. The surface tension of the liquid tries to make the surface area of the liquid smaller. Therefore, even if a positive pressure, if the pressure is small, the menisci can be held. If the positive pressure becomes larger, the liquid overflows. If the negative pressure becomes larger, the liquid ends up being drawn into the first channel member 4, therefore a liquid ejectable state cannot be maintained. For this reason, it is necessary to prevent the pressure difference of the menisci from increasing too much when the liquid flows from the second common channel 24 to the first common channel 20.

The wall surface of a first common channel 20 on the ejection hole surface 4-2 side forms a first damper 28A. One surface of the first damper 28A faces the first common channel 20, while the other surface faces a damper chamber 29. Due to existence of the damper chamber 29, the first damper 28A becomes deformable. By deformation, the volume of the first common channel 20 can be changed. When the liquid in the pressurizing chamber 10 is pressurized in order to eject the liquid, a portion of that pressure is transferred through the liquid to the first common channel 20. Due to this, the liquid in the first common channel 20 vibrates. That vibration is sometimes transferred to the original pressurizing chamber 10 or other pressurizing chamber 10, whereupon fluid crosstalk is generated causing fluctuation of ejection characteristics of the liquid. If there is the first damper 28A, the first damper 28A vibrates by the vibration of the liquid transferred to the first common channel 20, and the vibration of the liquid attenuates. Due to this, it becomes harder to sustain the vibration of the liquid in the common channel 20, therefore the influence of fluid crosstalk can be made smaller. That is, degradation of the ejection characteristics due to the transfer of the pressure through the first common channel 20 can be reduced. Further, the first damper 28A performs the role of stabilizing supply and discharge of the liquid as well.

The wall surface of a second common channel 24 on the pressurizing chamber surface 4-1 side forms a second damper 28B. One surface of the second damper 28B faces the second common channel 24, while the other surface faces the damper chamber 29. The second damper 28B can reduce the influence of fluid crosstalk in the same way as the first damper 28A. That is, degradation of ejection characteristics due to the transfer of the pressure through the second common channel 24 can be reduced. Further, the second damper 28B performs the role of stabilizing the supply and discharge of the liquid as well.

A pressurizing chamber 10 is arranged so as to face the pressurizing chamber surface 4-1 and is a hollow region including a pressurizing chamber body 10*a* receiving pressure from the pressurizing part 50 and a descender 10*b* formed by a partial channel linked with the ejection hole 8 opened in the ejection hole surface 4-2 from the bottom of the pressurizing chamber body 10*a*. The pressurizing chamber body 10*a* is a right circular cylinder shape and has a circular planar shape. Due to its circular planar shape, the amount of displacement where the pressurizing part 50 causes deformation with the same power and the change of volume of the pressurizing chamber 10 caused by displacement can be made larger. The descender 10*b* has a right circular cylinder shape smaller in diameter than the pressurizing chamber body 10*a* and is circular in cross-sectional shape. Further, when viewed from the pressurizing chamber surface 4-1, the descender 10*b* is arranged at the position within the pressurizing chamber body 10*a*.

The plurality of pressurizing chambers 10 are arranged in a zigzag state on the pressurizing chamber surface 4-1. The plurality of pressurizing chambers 10 configure the plurality of pressurizing chamber columns 11A along the first direction. In each pressurizing chamber column 11A, the pressurizing chambers 10 are arranged at substantially equal intervals. The pressurizing chambers 10 belonging to the adjoining pressurizing chamber columns 11A are arranged offset in the first direction by about half of the interval described above. Expressed otherwise, each pressurizing chamber 10 belonging to a certain pressurizing chamber column 11A is positioned at substantially the center in the first direction between two successive pressurizing chambers 10 which belong to the pressurizing chamber column 11A which is positioned adjacent to the former.

Due to this, the pressurizing chambers 10 belonging to every other of the pressurizing chamber columns 11A end up being arranged along the second direction, thereby configure a pressurizing chamber row 11B.

In the present embodiment, there are 51 first common channels 20 and 50 second common channels 24, so there are 100 pressurizing chamber columns 11A. Note that, here, dummy pressurizing chamber columns 11D configured by only dummy pressurizing chambers 10D which will be explained later are not included in the number of the pressurizing chamber columns 11A explained above. Further, second common channels 24 to which only the dummy pressurizing chambers 10D are directly linked are not included in the number of the second common channels 24 explained above. Further, 16 pressurizing chambers 10 are included in each pressurizing chamber column 11A. However, the pressurizing chamber column 11A positioned on the end in the second direction includes eight pressurizing chambers 10 and eight dummy pressurizing chambers 10D. As explained above, the pressurizing chambers 10 are arranged in a zigzag state, therefore there are 32 pressurizing chamber rows 11B.

The plurality of pressurizing chambers 10 are arranged on the ejection hole surface 4-2 in a lattice shape along the first direction and second direction. The plurality of ejection holes 8 configure a plurality of ejection hole columns 9A along the first direction. The ejection hole columns 9A and the pressurizing chamber columns 11A are arranged at substantially the same positions.

The centroids of areas of the pressurizing chambers 10 and the ejection holes 8 linked with the pressurizing chambers 10 are arranged offset in the first direction. In one pressurizing chamber column 11A, the direction of offset is the same. Between adjoining pressurizing chamber columns 11A, the directions of offset become inverse. Due to this, the ejection holes 8 linked with the pressurizing chambers 10 belonging to two pressurizing chamber rows 11B configure one ejection hole row 9B arranged along the second direction.

Accordingly, in the present embodiment, there are 100 ejection hole columns 9A and 16 ejection hole rows 9B.

The centroids of areas of the pressurizing chamber bodies 10*a* and the ejection holes 8 linked from the pressurizing chamber bodies 10*a* are offset in positions in substantially the first direction. The descenders 10*b* are arranged at positions offset in the direction of the ejection holes 8 relative to the pressurizing chamber bodies 10*a*. The side walls of the pressurizing chamber bodies 10*a* and the side walls of the descenders 10*b* are arranged so as to be contiguous. Due to this, it is possible to make it difficult for liquid to pool in the pressurizing chamber bodies 10*a*.

The ejection holes 8 are arranged at the central parts of the descenders 10*b*. Here, a "central part" means a region inside a circle centered about the centroid of area of the descender 10*b* and of half of the diameter of the descender 10*b*.

The connecting parts between the first individual channels 12 and the pressurizing chamber bodies 10*a* are arranged on the opposite sides to the descenders 10*b* relative to the centroids of areas of the pressurizing chamber bodies 10*a*. Due to this, the liquid flowing through the second individual channels 14 from the descenders 10*b* spreads through the entire pressurizing chamber bodies 10*a*, then flows toward the first individual channels 12. Due to this, it is difficult for liquid to pool in the pressurizing chamber bodies 10*a*.

The second individual channels 14 are led out from the surfaces of the descenders 10*b* on the ejection hole surface 4-2 sides to the surface direction and are linked with the second common channels 24. The led out direction is the same as the direction in which the descenders 10*b* are offset relative to the pressurizing chamber bodies 10*a*.

The angle formed by the first direction and the second direction is deviated from a right angle. For this reason, the ejection holes 8 belonging to each of the ejection hole columns 9A which are arranged along the first direction are arranged offset in the second direction by the amount of the angle off from the right angle. Further, the ejection hole columns 9A are arranged aligned in the second direction, therefore the ejection holes 8 belonging to the different ejection hole columns 9A are arranged offset in the second direction by that amount. By combining them, the ejection holes 8 in the first channel member 4 are aligned at constant intervals in the second direction. Due to this, printing can be carried out so as to fill a predetermined range with pixels formed by the ejected liquid.

If the ejection holes 8 belonging to one ejection hole column 9A are arranged on completely straight line along the first direction, printing is possible so as to fill the predetermined range as explained above. However, when they are arranged in that way, the effect of the deviation of the direction perpendicular to the second direction and the conveying direction upon the printing precision which occurs when setting the liquid ejection heads 2 in the printer 1 becomes larger. For this reason, preferably the ejection holes 8 are arranged by alternating between the adjoining ejection hole columns 9A from the arrangement of the ejection holes 8 on a straight line as explained above.

In the present embodiment, the arrangement of the ejection holes 8 becomes as follows. In FIG. 3, when projecting the ejection holes 8 to a direction perpendicular to the second direction, 32 ejection holes 8 are projected in a range of the imaginary line R, therefore the ejection holes 8 are aligned at intervals of 360 dpi in the imaginary line R. Due to this, if the printing paper P is conveyed in the direction perpendicular to the imaginary line R to perform printing, printing can be carried out with a resolution of 360 dpi. The ejection holes 8 projected in the imaginary line R are all (16) of the ejection holes 8 belonging to one ejection hole column 9A and halves (8) of the ejection holes 8 belonging to the two ejection hole columns 9A positioned at the two sides of the ejection hole column 9A. In order to form such configuration, in each ejection hole row 9B, the ejection holes 8 are aligned at intervals of 22.5 dpi. This is because 360/16 is equal to 22.5.

The first common channels 20 and the second common channels 24 form straight lines in a range where the ejection holes 8 are linearly aligned and are offset in parallel between the ejection holes 8 forming lines offset from the straight lines. In the first common channels 20 and second common channels 24, there are few such offset portions, therefore the channel resistances become small. Further, these parallel offset parts are arranged at positions that are not superimposed over the pressurizing chambers 10, therefore fluctuation of ejection characteristics can be made smaller for each of the pressurizing chambers 10.

One pressurizing chamber column 11A on each of the two ends of the first direction (that is, two columns in total) includes usual pressurizing chambers 10 and dummy pressurizing chambers 10D (for this reason, this pressurizing chamber column 11A will be sometimes referred to as the "dummy pressurizing chamber column 11D"). Further, on further outer side of the dummy pressurizing chamber column 11D, one dummy pressurizing chamber column 11D (that is, two columns in total on the two ends) having only dummy pressurizing chambers 10D aligned therein is arranged. Each channel located on each of the two ends of the second direction (that is, two in total) has the same shape as that of a usual first common channel 20. However, it is not directly linked with the pressurizing chamber 10 and is linked with only the dummy pressurizing chambers 10D.

The first channel member 4 has end part channels 30 which are positioned at the outside of common channel group configured by the first common channels 20 and second common channels 24 in the second direction and extend in the first direction. The end part channels 30 are channels which connect openings 30*c* arranged on the further outer sides of the openings 20*a* in the first common channels 20 aligned on the pressurizing chamber surface 4-1 and openings 30*d* arranged on the further outer sides of the openings 24*a* in the second common channels 24 aligned on the pressurizing chamber surface 4-1.

In order to stabilize the ejection characteristics of the liquid, the head body 2*a* is controlled so as to make the temperature constant. Further, the ejection and circulation of liquid are stabilized more as the viscosity of the liquid becomes lower. Therefore, the temperature is basically controlled to a normal temperature or more. For this reason, basically the head body 2*a* is heated. However, where the environmental temperature is high, sometimes the head body 2*a* is cooled as well.

In order to keep the temperature constant, a liquid ejection head 2 is provided with a heater or the liquid to be supplied is adjusted in temperature. In any case, when there is a difference between the environmental temperature and the target temperature, a greater amount of heat is radiated from the end parts of the head body 2*a* in the longitudinal direction (second direction), therefore temperatures of the pressurizing chambers 10 positioned at the ends in the second direction are apt to become lower relative to the temperature of the liquid in the pressurizing chambers 10 positioned in the central part of the second direction. By provision of the end part channels 30, the temperatures of the pressurizing chambers 10 positioned at the ends in the second direction become harder to fall, therefore the variation in ejection characteristics of the liquids ejected from the pressurizing chambers 10 can be made smaller, so the printing precision can be improved.

The end part channels 30 are the channels which link a first integrating channel 22 and a second integrating channel 26. The channel resistances of the end part channels 30 are preferably smaller than the channel resistances of the first common channels 20 and second common channels 24. By doing this, the amounts of liquid flowing in the end part channels 30 becomes larger, therefore a temperature drop on inner side from the end part channels 30 can be suppressed more.

The end part channels 30 are provided with broad portions 30*a* in which the widths of the channels are broader than the widths of the common channels. Dampers are provided on the pressurizing chamber surface 4-1 sides in the broad portions 30*a*. In each damper, one surface faces the broad portion 30*a*, and the other surface faces the damper chamber, so it has become deformable. The damping capability of the damper is largely influenced by the portion having the narrowest span in the deformable region. For this reason, by providing the damper so as to face the broad portion 30*a*, a damper having a high damping capability can be formed.

The width of the broad portion 30*a* is preferably 2 times or more, particularly preferably 3 times or more, of the width of the common channels. If the channel resistance becomes too low due to providing the broad portions 30*a*, a narrowed portion 30*b* may be provided to adjust the channel resistance as well.

The second channel member 6 is joined to the pressurizing chamber surface 4-1 of the first channel member 4. The second channel member 6 has the second integrating channel 26 supplying liquid to the second common channels 24 and the first integrating channel 22 collecting the liquid in the first common channels 20. The thickness of the second channel member 6 is thicker than the first channel member 4 and is about 5 to 30 mm. Note that, the first integrating channel 22 and the second integrating channel 26 will be sometimes referred to as the "integrating channels" together.

The second channel member 6 is joined in a region of the pressurizing chamber surface 4-1 of the first channel member 4 where the piezoelectric actuator substrate 40 is not connected. More specifically, it is joined so as to surround the piezoelectric actuator substrate 40. By doing this, deposition of a portion of the ejected liquid as mist onto the piezoelectric actuator substrate 40 can be suppressed. Further, it means fixing the first channel member 4 on the periphery, therefore vibration of the first channel member 4 along with driving of the pressurizing parts 50 to cause resonation and so on can be reduced.

Further, a through hole 6*c* vertically penetrates through the center part of the second channel member 6. In the through hole 6*c*, a circuit member such as an FPC (flexible printed circuit) transmitting a driving signal for driving the piezoelectric actuator substrate 40 is passed. Note that, the first channel member 4 side in the through hole 6*c* becomes a widened part 6*ca* having a broad width in the transverse direction. The circuit member which extends from the piezoelectric actuator substrate 40 to the two sides of the transverse direction is bent in the widened part 6*ca* and heads upward, then passes through the through hole 6*c*. Note that, the projecting portion expanding at the widened part 6*ca* is liable to damage the circuit member, therefore may be formed rounded.

By arranging the second integrating channel 22 in the second channel member 6 separate from the first channel member 4 and thicker than the first channel member 4, the cross-sectional area of the first integrating channel 22 can be made larger. Due to that, the difference of pressure loss due to the difference in positions where the first integrating channel 22 and the first common channel 20 are linked can be made smaller. The channel resistance of the first integrating channel 22 (more correctly, the channel resistance in a range of the first integrating channel 22 linked with the first common channels 20) is preferably controlled to 1/100 or less of that of the first common channels 20.

By arranging the second integrating channel 26 in the second channel member 6 separate from the first channel member 4 and thicker than the first channel member 4, the cross-sectional area of the second integrating channel 26 can be made larger. Due to that, the difference of pressure loss due to the difference in positions where the second integrating channel 26 and the second common channels 24 are linked can be made smaller. The channel resistance of the second integrating channel 26 (more correctly, the channel resistance of a range in the second integrating channel 26 linked with the first integrating channel 22) is preferably controlled to 1/100 or less of the second common channels 24.

The first integrating channel 22 is arranged at one end of the second channel member 6 in the transverse direction, while the second integrating channel 26 is arranged at the other end of the second channel member 6 in the transverse direction. Further, the two of the first integrating channel 22 and second integrating channel 26 are arranged so as to face the first channel member 4 and are individually linked with the first common channels 20 and the second common channels 24. By such a configuration, the cross-sectional areas of the first integrating channel 22 and the second integrating channel 26 can be made larger (that is, the channel resistances can be made smaller), and the periphery of the first channel member 4 is fixed by the second channel member 6 to raise the rigidity, and further the through hole 6*c* through which the circuit member passes can be provided.

The second channel member 6 is configured by stacking plates 6*a* and 6*b* of the second channel member. In the upper surface of the plate 6*b*, a first groove forming the first integrating channel body 22*a* as a part in the first integrating channel 22 which extends in the second direction and has a low channel resistance and a second groove which becomes the second integrating channel body 26 as a part in the second integrating channel 26 which extends in the second direction and has a low channel resistance are arranged.

Most of the lower side of the first groove which becomes the integrated channel body 22*a* (the direction of the first channel member 4) is closed by the pressurizing chamber surface 4-1. A portion is linked with the openings 20*a* in the first common channels 20 opened on the pressurizing chamber surface 4-1.

Most of the lower side of the second groove which becomes the second integrated channel body 26*a* is closed by the pressurizing chamber surface 4-1. A portion is linked with the openings 24*a* in the second common channels 24 opened on the pressurizing chamber surface 4-1.

In the plate 6*a*, an opening 22*c* is provided at the end part of the first integrating channel 22 in the second direction. In the plate 6*a*, an opening 26*c* is provided in the end part of the second integrating channel 26 in the fourth direction of the opposite direction to the first direction. The liquid is supplied to the opening 26*c* of the second integrating channel 26 and is collected from the opening 22*c* of the second integrating channel 22. However, the configuration is not limited to this. The supply and the collection may be reversed.

The first integrating channel 22 and the second integrating channel 26 may be provided with dampers so that the supply or discharge of the liquid becomes stable against fluctuation of the amount of ejection of the liquid as well. Further, by providing filters in the first integrating channel 22 and second integrating channel 26, foreign substances, air bubbles, etc. may be prevented from entering into the first channel member 4 as well.

To the top surface of the first channel member 4 formed by the pressurizing chamber surface 4-1, the piezoelectric actuator substrate 40 including the pressurizing parts 50 is joined. The pressurizing parts 50 are positioned on the pressurizing chambers 10. The piezoelectric actuator substrate 40 occupies a region having almost the same shape as that of the pressurizing chamber group formed by the pressurizing chambers 10. Further, the openings of the pressurizing chambers 10 are closed by the piezoelectric actuator substrate 40 being joined to the pressurizing chamber surface 4-1 of the first channel member 4. The piezoelectric actuator substrate 40 has a rectangular shape which is longer in the same direction as that of the head body 2*a*. Further, to the piezoelectric actuator substrate 40, an FPC or other signal transmission part for supplying signals to the pressurizing parts 50 is connected. In the second channel member 6, there is a vertically penetrating through hole 6*c* at the center. The signal transmission part passes through the through hole 6*c* and is electrically connected with the control part 88. If the signal transmission part is shaped so as to extend in the transverse direction from the end formed by one long side of the piezoelectric actuator substrate 40 toward the end formed by the other long side so that the wirings arranged in the signal transmission part extend along the transverse direction and are aligned in the longitudinal direction, the distance between wirings can be more easily obtained, so this is preferred.

At the positions on the upper surface of the piezoelectric actuator substrate 40 which face the pressurizing chambers 10, individual electrodes 44 are arranged.

The first channel member 4 has a multilayer structure obtained by stacking a plurality of plates. From the pressurizing chamber surface 4-1 side of the first channel member 4, 12 plates from the plate 4*a* to the plate 4*i* are stacked in order. In these plates, a large number of holes and grooves are formed. These plates can be formed by using for example various types of metals, plastics, etc. The holes and grooves can be formed by for example etching. Further, the plates adjacent to each other can be joined by using for example an adhesive or the like. The thickness of each plate is made about 10 to 300 μm, so the precision of formation of the holes and grooves formed can be raised. The plates are stacked positioned so that these holes and grooves are communicated with each other and configure the first common channels 20 and other channels.

At the pressurizing chamber surface 4-1 of the plate shaped first channel member 4, pressurizing chamber bodies 10*a* are opened. The piezoelectric actuator substrate 40 is joined to it. Further, at the pressurizing chamber surface 4-1, openings 24*a* for supplying liquid to the second common channels 24 and openings 20*a* collecting the liquid from the first common channels 20 are opened. At the surface of the first channel member 4 at the opposite side to the pressurizing chamber surface 4-1, that is, at the ejection hole surface 4-2, ejection holes 8 are opened. Note that, a plate may be further stacked on the pressurizing chamber surface 4-1 to close the openings of the pressurizing chamber bodies 10*a*, then the piezoelectric actuator substrate 40 joined to the top thereof. By doing this, the possibility of the ejected liquid contacting the piezoelectric actuator substrate 40 can be reduced, and the reliability can be made higher.

A structure for ejecting liquid includes a pressurizing chamber 10 and ejection hole 8. The pressurizing chamber 10 is configured by a pressurizing chamber body 10*a* facing a pressurizing part 50 and a descender 10*b* having a smaller cross-sectional area than the pressurizing chamber body 10*a*. The pressurizing chamber body 10*a* is formed in the plate 4*a*. The descender 10*b* is configured by holes formed in the plates 4*b* to 4*k* superimposed on each other and further closed by the first plate 4*m* (at portion other than the ejection hole 8).

The pressurizing chamber body 10*a* is linked with The first individual channel 12, and the first individual channel 12 is linked with a first common channel 20. The first individual channel 12 includes a circular hole penetrating through the plate 4*b*, a through groove which extends in the surface direction in the plate 4*c*, and a circular hole penetrating through the plate 4*d*. The first common channel 20 is formed by superimposing holes in the plates 4*f* to 4*i* on each other and further closing them on the upper side by the plate 4*e* and on the lower side by the plate 4*j*.

The descender 10*b* is linked with a second individual channel 14. The second individual channel 14 is linked with a second common channel 24. The second individual channel 14 is a through groove extending in the surface direction in the plate 4*j*. The second common channel 24 is formed by superimposing holes in the plates 4*f* to 4*i* on each other and further closing them on the upper side by the plate 4*e* and on the lower side by the plate 4*j*.

Summarizing the flow of the liquid, the liquid supplied to a second integrating channel 26 passes through a second common channel 24 and second individual channel 14 in order and enters into a pressurizing chamber 10 where part of the liquid is ejected from an ejection hole 8. The liquid which is not ejected passes through a first individual channels 12, enters into a first common channel 20, and then enters into the first integrating channel 22 and is discharged to the outside of the head body 2*a*.

The piezoelectric actuator substrate 40 has a multilayer structure comprised of piezoelectric members of two piezoelectric ceramic layers 40*a* and 40*b*. Each of these piezoelectric ceramic layers 40*a* and 40*b* has a thickness of about 20 μm. That is, the thickness from the upper surface of the piezoelectric ceramic layer 40*a* of the piezoelectric actuator substrate 40 to the lower surface of the piezoelectric ceramic layer 40*b* is about 40 μm. The ratio of thicknesses of the piezoelectric ceramic layer 40*a* and the piezoelectric ceramic layer 40*b* is controlled to 3:7 to 7:3, preferably 4:6 to 6:4. Both the piezoelectric ceramic layers 40*a* and 40*b* extend so as to be straddle a plurality of pressurizing chambers 10. These piezoelectric ceramic layers 40*a* and 40*b* are made of for example lead zirconate titanate (PZT)-based, $NaNbO_3$-based, $BaTiO_3$-based, $(BiNa)NbO_3$-based, $BiNaNb_5O_{15}$-based, or other ceramic material having ferroelectricity.

The piezoelectric actuator substrate 40 has a common electrode 42 made of Ag—Pd or another metal material and individual electrodes 44 made of Au or another metal material. The thickness of the common electrode 42 is about 2 μm, and the thicknesses of the individual electrodes 44 are about 1 μm.

The individual electrodes 44 are individually arranged on the upper surface of the piezoelectric actuator substrate 40 at positions facing the pressurizing chambers 10. Each individual electrode 44 includes an individual electrode body 44*a* which is smaller in planar shape than a pressurizing chamber body 10*a* by one size and has a substantially similar shape to the pressurizing chamber body 10*a* and a lead out electrode 44*b* which is led out from the individual electrode body 44*a*. On the portion of one end of the lead out electrode 44*b* which is led out to the outside of the region facing the pressurizing chamber 10, a connection electrode 46 is formed. The connection electrode 46 is for example formed by a conductive resin containing for example silver particles or other conductive particles to a thickness of about 5 to 200 μm. Further, the connection electrode 46 is electrically joined with an electrode provided in a signal transmission part.

Further, on the upper surface of the piezoelectric actuator substrate 40, a common electrode-use surface electrode (not shown) is formed. The common electrode-use surface electrode and the common electrode 42 are electrically connected through a not shown through conductor provided in the piezoelectric ceramic layer 40*a*.

Details will be explained later, but the individual electrodes 44 are supplied with driving signals from the control part 88 through the signal transmission part. The driving signals are supplied at constant cycles synchronized with the conveying speed of the printing paper P.

The common electrode 42 is formed in the region between the piezoelectric ceramic layer 40*a* and the piezoelectric ceramic layer 40*b* over almost the entire surface in the surface direction. That is, the common electrode 42 extends so as to cover all pressurizing chambers 10 in the region facing the piezoelectric actuator substrate 40. The common electrode 42 is linked with the common electrode-use surface electrode which is formed on the piezoelectric ceramic layer 40*a* at a position avoiding the group of electrodes configured by the individual electrodes 44 through a via hole formed penetrating through the piezoelectric ceramic layer 40*a*, is grounded, and is held at the ground potential. The common electrode-use surface electrode is directly or indirectly connected to the control part 88 in the same way as the plurality of individual electrodes 44.

A part of the piezoelectric ceramic layer 40*a* which is sandwiched between an individual electrode 44 and the common electrode 42 is polarized in the thickness direction and forms a displacement element of a unimorph structure which displaces when voltage is applied to the individual electrode 44. More specifically, when giving the individual electrode 44 a potential different from that for the common electrode 42 and applying an electric field to the piezoelectric ceramic layer 40*a* in its polarization direction, that portion to which the electric field is applied acts as an active portion which is distorted by the piezoelectric effect. In this configuration, when the individual electrode 44 is made a predetermined positive or negative potential relative to the common electrode 42 by the control part 88 so that the electric field and the polarization become the same direction, the portion (active portion) sandwiched by the electrodes in the piezoelectric ceramic layer 40*a* contracts in the surface direction. On the other hand, the non-active layer of the piezoelectric ceramic layer 40*b* is not influenced by the electric field, therefore does not spontaneously contract and acts to restrict the deformation of the active portion. As a result, a difference arises in the strain in the polarization direction between the piezoelectric ceramic layer 40*a* and the piezoelectric ceramic layer 40*b*, therefore the piezoelectric ceramic layer 40*b* deforms (unimorph deformation) so as to project to the pressurizing chamber 10 side. In this way, the pressurizing part 50 for pressurizing the liquid in the pressurizing chamber 10 is configured by the part sandwiched between the individual electrode 44 and the common electrode 42 in the piezoelectric ceramic layer 40*a* and by the individual electrode 44 and the common electrode 42 which sandwich that part.

Further, the ejection operation of the liquid will be explained. Under the control from the control part 88, the pressurizing parts 50 are driven (displaced) according to the driving signals supplied to the individual electrodes 44 through the driver IC etc. In the present embodiment, the liquid can be ejected by a variety of driving signals. Here, however, so-called pull-push driving will be explained.

An individual electrode 44 is made a potential higher than the common electrode 42 (below, referred to as a "high potential") in advance. Whenever there is an ejection request, the individual electrode 44 is once made the same potential as the common electrode 42 (below, referred to as a "low potential") and, after that, is again made the high potential at a predetermined timing. Due to this, at the timing when the individual electrode 44 becomes the low potential, the piezoelectric ceramic layers 40*a* and 40*b* (begin to) return to their original (flat) shapes, therefore the capacity of the pressurizing chamber 10 increases compared with the initial state (state where the potentials of the two electrodes are different). Due to this, a negative pressure is given to the liquid in the pressurizing chamber 10. This being so, the liquid in the pressurizing chamber 10 begins to vibrate by a natural vibration period. Specifically, first, the volume of the pressurizing chamber 10 begins to increase and the negative pressure gradually becomes smaller. Next, the volume of the pressurizing chamber 10 becomes the maximum, and the pressure becomes substantially zero. Next, the volume of the pressurizing chamber 10 begins to decrease, and the pressure becomes higher. After that, at the timing when the pressure becomes substantially maximum, the individual electrode 44 is made the high potential. This being so, the vibration applied first and the vibration applied next overlap, therefore a larger pressure is applied to the liquid. This pressure is propagated through the descender 10*b* and makes the liquid be ejected from the ejection hole 8.

That is, by supplying a driving signal of a pulse based on a high potential and made a low potential for a constant period to an individual electrode 44, a droplet can be ejected. If this pulse width is a time of half of the natural vibration period of the liquid in the pressurizing chamber 10, that is, the AL (acoustic length), in principle, the ejection speed and ejection amount of the liquid can be made the maximum. The natural vibration period of the liquid in the pressurizing chamber 10 is greatly influenced by the physical properties of the liquid and the shape of the pressurizing chamber 10. Other than these, it is also influenced by the physical properties of the piezoelectric actuator substrate 40 and characteristics of the channels linked with the pressurizing chamber 10.

Next, the structure on the ejection hole surface 4-2 side of the first channel member 4 will be explained by using FIG. 5 and FIG. 7. FIG. 5 is a vertical cross-sectional view along the V-V line in FIG. 4. FIG. 7 is a schematic plan view showing a state when viewing a part of the second plate 4*k* configuring the first channel member 4 from the opposite side to the first plate 4*m*. The ejection hole surface 4-2 side of the first channel member 4 is configured by the first plate 4*m*, second plate 4*k*, and plate 4*j* arranged in that order from the ejection hole surface 4-2 side.

The surface of the plate 4*j* located on the opposite side to the ejection hole surface 4-2 is in contact with a plurality of common channels (first common channels 20 and second common channels 24) which extend along the first direction. Recessed portions are formed on the opposite side (second plate 4*k* side) from the parts contacting the common channels (20, 24) in the plate 4*j*. Further, in the surface of the second plate 4*k* on the plate 4*j* side, recessed portions are also formed in the parts facing the recessed portions formed in the plate 4*j*. Due to the spaces formed by the plurality of recessed portions formed in the plate 4*j* and the plurality of recessed portions formed in the second plate 4*k* being arranged so as to face each other in this way, the plurality of damper chambers 29 extending in the first direction along the plurality of common channels (20, 24) are configured. Further, a first damper 28A is configured by a wall partitioning a first common channel 20 and a damper chamber 29, and a second damper 28B is configured by a wall partitioning a second common channel 24 and a damper chamber 29.

The second plate 4*k* has a plurality of first parts 91 of parts sandwiched by the damper chambers 29 and the first plate 4*m*. Further, on first surfaces 91*a* of the surfaces on the opposite side to the first plate 4*m* at the first parts 91, a covering layer 93 is unevenly provided.

The covering layer 93 can be configured by using a metal, resin, or other various known materials. For example, the covering layer 93 can be formed by joining a separately prepared plate shaped covering layer 93 to the first surfaces 91*a* of the first parts 91 of the second plate 4*k* by an adhesive or another joining member. Further, when use is made of a resin as the material configuring the covering layer 93, for example, the covering layer 93 can be formed by coating an uncured resin which forms the covering layer 93 on the first surfaces 91*a* of the first parts 91 and then curing them. Note that, the covering layer 93 may be a laminate formed by a plurality of layers, and the first plate 4*m* and the second plate 4*k* may be composite bodies formed by pluralities of members.

The covering layer must be unevenly provided on the first surfaces 91*a* of the first parts 91. The "unevenly provided" state means a state which is not a state where "the covering layer 93 is provided over the entire first surfaces 91*a* of the first parts 91 with the same thickness". That is, this means a state where "there are parts provided with the covering layer 93 and parts not provided with the covering layer 93 on the first surfaces 91*a* of the first parts 91" or a state where "the covering layer 93 is provided over the entire first surfaces 91*a* of the first parts 91, but the thickness of the covering layer 93 differs according to the location".

Note that, the state where "there are parts provided with the covering layer 93 and parts not provided with the covering layer 93 on the first surfaces 91*a* of the first parts 91" is desirable. However, it may be a state where "the covering layer 93 is provided over the entire first surfaces 91*a* of the first parts 91, but the thickness of the covering layer 93 differs according to the location" as well. In this case, the difference of thickness is desirably large. The thickness of a large thickness part having a large thickness is desirably 1.5 times or more of the thickness of a small thickness part having a small thickness. Note that, the difference in thickness between the large thickness part and the small thickness part is desirably large. The thickness of the large thickness part is desirably 2 times or more, more further desirably 3 times or more that of the small thickness part.

Note that, in the present embodiment, as shown in FIG. 7, there are first regions 93A provided with the covering layer 93 and second regions 94 not provided with covering layer 93 on the first surfaces 91*a* of the first parts 91. There are a plurality of second regions 94 having different planar shapes.

As explained above, the liquid ejection head 2 in the present embodiment has a plurality of pressurizing parts 50 for pressurizing the liquid and a first channel member 4. The first channel member 4 has a plurality of ejection holes 8 which eject a liquid, common channels (20, 24) linked with the plurality of ejection holes 8, damper chambers 29 configured by spaces arranged outside of the common channels (20, 24), and dampers (28A, 28B) configured by walls partitioning the common channels (20, 24) and the damper chambers 29. Further, the first channel member 4 is configured by stacking a plurality of flat plates (4*a* to 4*m*). The plurality of plates (4*a* to 4*m*) include a first plate 4*m* having a plurality of ejection holes 8 and a second plate 4*k* adjacent to the first plate 4*m*. The second plate 4*k* has first parts 91 sandwiched by the first plate 4*m* and the damper chambers 29. Covering layers 93 are unevenly provided on the first surfaces 91*a* of the first parts 91. The liquid ejection head 2 in the present embodiment having such a configuration can reduce generation of a large vibration in the surface in which the ejection holes 8 are formed (ejection hole surface 4-2) as will be explained below.

If the dampers (28A, 28B) are formed in the common channels (20, 24) as in the liquid ejection head 2 in the present embodiment, degradation of ejection characteristics caused by the transmission of pressure fluctuations through the common channels (20, 24) can be reduced. However, as shown in FIG. 5, if the damper chambers 29 are arranged close to the ejection hole surface 4-2, the strength of the first parts 91 sandwiched by the ejection hole surface 4-2 and the damper chambers 29 falls, therefore there is the problem that the first parts 91 are apt to vibrate greater than the other portions at the ejection hole surface 4-2.

In the liquid ejection head 2 in the present embodiment, the covering layer 93 is unevenly provided on the first surfaces 91*a* of the first parts 91. Due to this, the rigidity and mass distribution in the composite bodies formed by the integrally vibrating first parts 91 and covering layer 93 become nonuniform, therefore the structural symmetry of the composite bodies can be lowered. Due to this, it is possible to disperse the resonance frequency by removing the degeneracy of the resonance mode, therefore it becomes possible to reduce large vibration of the composite bodies of the first parts 91 and covering layer 93 at a specific frequency.

In order to raise such a vibration reduction effect, it is necessary to make the structural symmetry in the composite bodies of the first parts 91 and covering layer 93 low. Accordingly, the planar shapes of the first regions 93A on which the covering layer 93 is formed desirably exhibit a low symmetry. That is, desirably the planar shapes of the first regions 93A do not have line symmetry, rotation symmetry, or other symmetry.

Further, in the present embodiment, as shown in FIG. 7, at the first surfaces 91*a* of the first parts 91, there are first regions 93A provided with the covering layer 93 and second regions 94 not provided with covering layer 93. Due to this, the difference in the rigidity and mass between the first regions 93A and the second regions 94 in the composite bodies of the first parts 91 and covering layer 93 can be made large. Therefore, it becomes possible to make the structural symmetry fall, therefore the effect of reducing large vibration at a specific frequency can be further raised.

Further, as shown in FIG. 7, pluralities of ejection holes 8 are arranged so as to form a plurality of columns. The first parts 91 are positioned between the columns and have shapes long in a first direction of the direction along the columns. In such a case, desirably the covering layer 93 has shapes of broad width parts and narrow width parts alternately arranged along the first direction. Due to this, the structural symmetry can be lowered, therefore degradation of ejection characteristics caused by large vibration due to the resonance phenomena in the portions sandwiched between the ejection hole surface 4-2 and the damper chambers 29 can be reduced.

Further, at this time, desirably the widths of the narrow width parts adjacent to each other are made different from each other. That is, as shown in FIG. 7, at the time when the widths of the narrow width part are defined as W1, W2, W3, W4, W5, and W6, desirably the widths are set so that W1 and W2 are different, W2 and W3 are different, W4 and W5 are different, and W5 and W6 are different. Due to this, the structural symmetry can be further lowered, therefore the effect of reducing large vibration at a specific frequency can be further raised.

Further, in the present embodiment, the linear expansion coefficient of the material configuring the first plate 4*m* and the linear expansion coefficient of the material configuring the covering layer 93 may be made larger than the linear expansion coefficient of the material configuring the second plate 4*k*. Due to this, at the time when the adhesive for bonding the first plate 4*m* and the second plate 4*k* is cured by heating and the temperature is returned to a normal temperature, the first plate 4*m* and the covering layer 93 contract larger than the second plate 4*k*. Due to this, deformation can be caused so that the parts in the ejection hole surface 4-2 adjacent to the damper chambers 29 become slightly recessed portions, and the recess amounts in the recessed portions can be prevented from being excessively large. Due to this, it is possible to prevent the parts having ejection holes 8 formed therein in the ejection hole surface 4-2 from becoming relatively recessed portions, therefore occurrence of the problem of unwiped portions being formed in the vicinities of the ejection holes 8 can be reduced. Further, it is possible to prevent the formation of unwiped portions at the parts in the ejection hole surface 4-2 adjacent to the damper chambers 29 due to the amounts of recess of the portions adjacent to the damper chambers 29 in the ejection hole surface 4-2 becoming excessively large.

Note that, if the thickness of the covering layer 93 is made smaller than the thickness of the first plate 4*m*, deformation resulting in the parts adjacent to the damper chambers 29 in the ejection hole surface 4-2 projecting outward can be easily prevented.

Further, as shown in FIG. 7, the covering layer 93 may be unevenly provided at the central parts of the first parts 91 by provision of regions of no covering layer 93 at the circumferential edge parts of the first parts 91. Due to this, it is possible to raise the effect of preventing the recess amounts of the parts adjacent to the damper chambers 29 in the ejection hole surface 4-2 from becoming excessively large.

At the time when the linear expansion coefficient of the material configuring the first plate 4*m* and the linear expansion coefficient of the material configuring the covering layer 93 are made larger than the linear expansion coefficient of the material configuring the second plate 4*k*, in order to satisfy the condition of the linear expansion coefficients, the materials can be suitably selected from a group of various known materials. For example, as one example, it is possible to select a stainless steel alloy as the material of the plates 4*a* to 4*k* including the second plate 4*k*, select nickel as the material of the first plate 4*m*, and select an epoxy resin as the material of the covering layer 93. Further, as another example, it is possible to select a stainless steel alloy as the material of the plates 4*a* to 4*k* including the second plate 4*k*, select a polyimide resin as the material of the first plate 4*m*, and select an epoxy resin as the material of the covering layer 93. Further, a metal having a small linear expansion coefficient such as carbon steel can be selected as the material of the plates 4*a* to 4*k* including the second plate 4*k*, a metal having a large linear expansion coefficient such as tin can be selected as the material of the first plate 4*m*, and a metal having a large linear expansion coefficient and low melting point such as tin or lead can be selected as the material of the covering layer 93.

When use is made of tin or another metal having a low melting point as the material configuring the covering layer 93, for example, it is possible to stack the first plate 4*m* and the second plate 4*k*, then place a paste like, powdery, or granular metal on the first surfaces 91*a* of the first parts 91, using the heating when hardening the adhesive for bonding the first plate 4*m* and the second plate 4*k* to melt the metal, then return it to ordinary temperature to thereby form the covering layer 93.

Further, when selecting nickel or a polyimide as the material configuring the covering layer 93, for example, the plate shaped covering layer 93 is adhered to the first surfaces 91*a* of the first parts 91 through an adhesive, and the adhesive is cured at the same time as heating and hardening the adhesive for bonding the first plate 4*m* and the second plate 4*k* to thereby form the covering layer 93.

Second Embodiment

Figure 8:
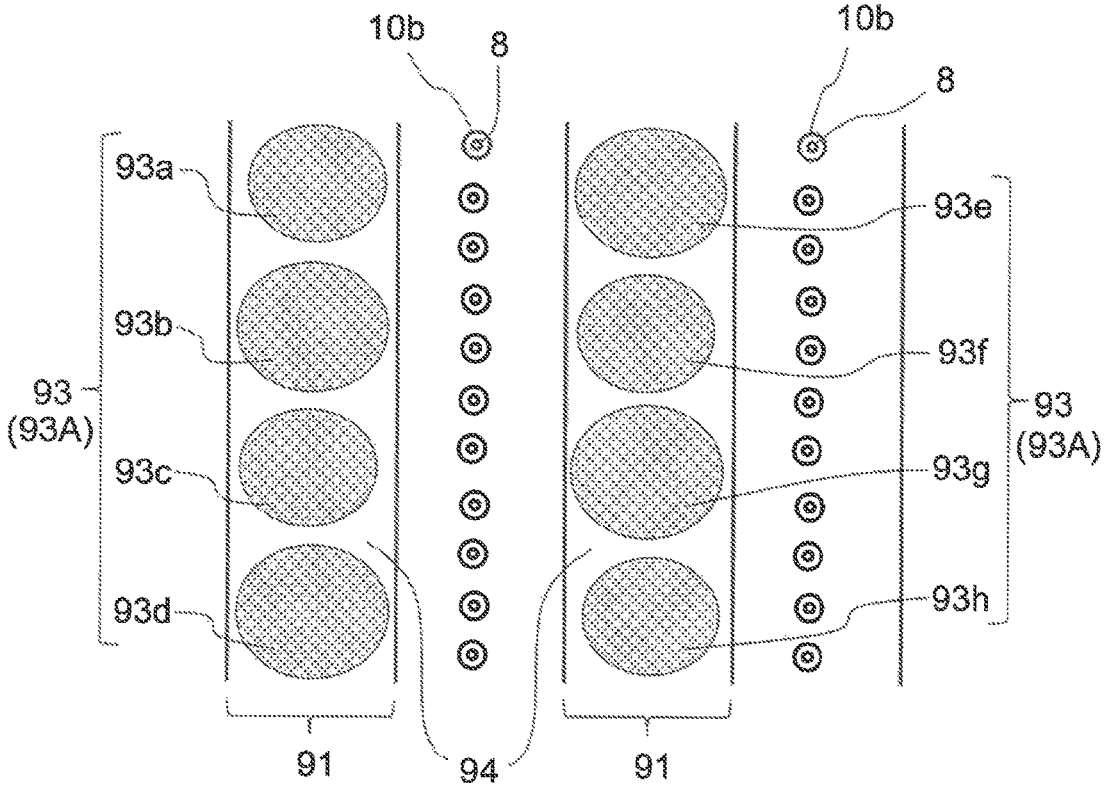
FIG. 8 is a schematic plan view showing the same state as that in FIG. 7 in the liquid ejection head in a second embodiment.

FIG. 8 is a schematic plan view showing the same state as FIG. 7 in the liquid ejection head in a second embodiment. Note that, in the present embodiment, the explanation will be given of the points different from the first embodiment explained before, the same components will be assigned the same notations, and overlapping explanations will be omitted.

In the present embodiment, the covering layer 93 is arranged divided into a plurality of regions. That is, as shown in FIG. 8, first regions 93A provided with the covering layer 93 are divided into a plurality of regions (93*a*, 93*b*, 93*c*, 93*d*, 93*e*, 93*f*, 93*g*, 93*h*). Even by such a structure, it is possible to reduce large vibration of the portions sandwiched by the ejection hole surface 4-2 and the damper chambers 29 at a specific frequency.

Further, at this time, desirably the areas of the regions which are adjacent to each other among the plurality of regions in the covering layer 93 are made different from each other. That is, as shown in FIG. 8, desirably the areas are set so that the area of the region 93*a* and the area of the region 93*b* are different, the area of the region 93*b* and the area of the region 93*c* are different, the area of the region 93*c* and the area of the region 93*d* are different, the area of the region 93*e* and the area of the region 93*f* are different, the area of the region 93*f* and the area of the region 93*g* are different, and the area of the region 93*g* and the area of the region 93*h* are different. Due to this, the structural symmetry can be further lowered, therefore it is possible to further reduce degradation of ejection characteristics due to generation of large vibration caused by the resonance phenomena in the portions sandwiched between the ejection hole surface 4-2 and the damper chambers 29.

Third Embodiment

Figure 9:
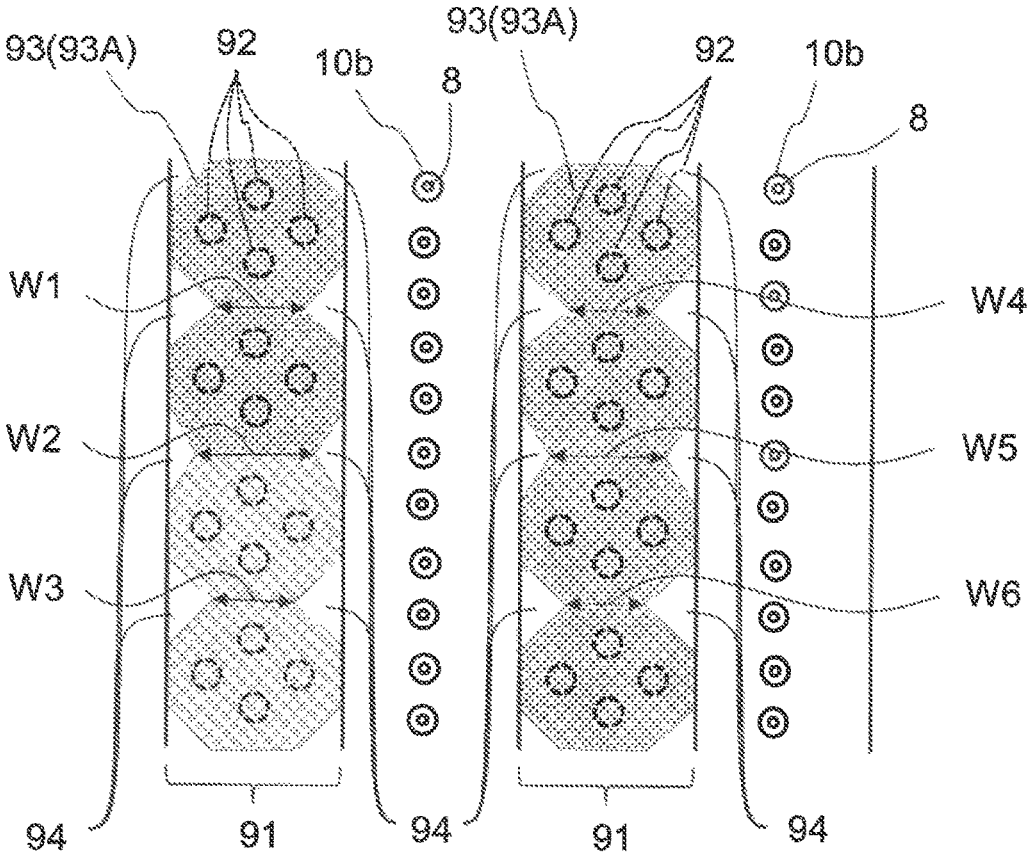
FIG. 9 is a schematic plan view showing the same state as that in FIG. 7 in a liquid ejection head in a third embodiment.
Figure 10:
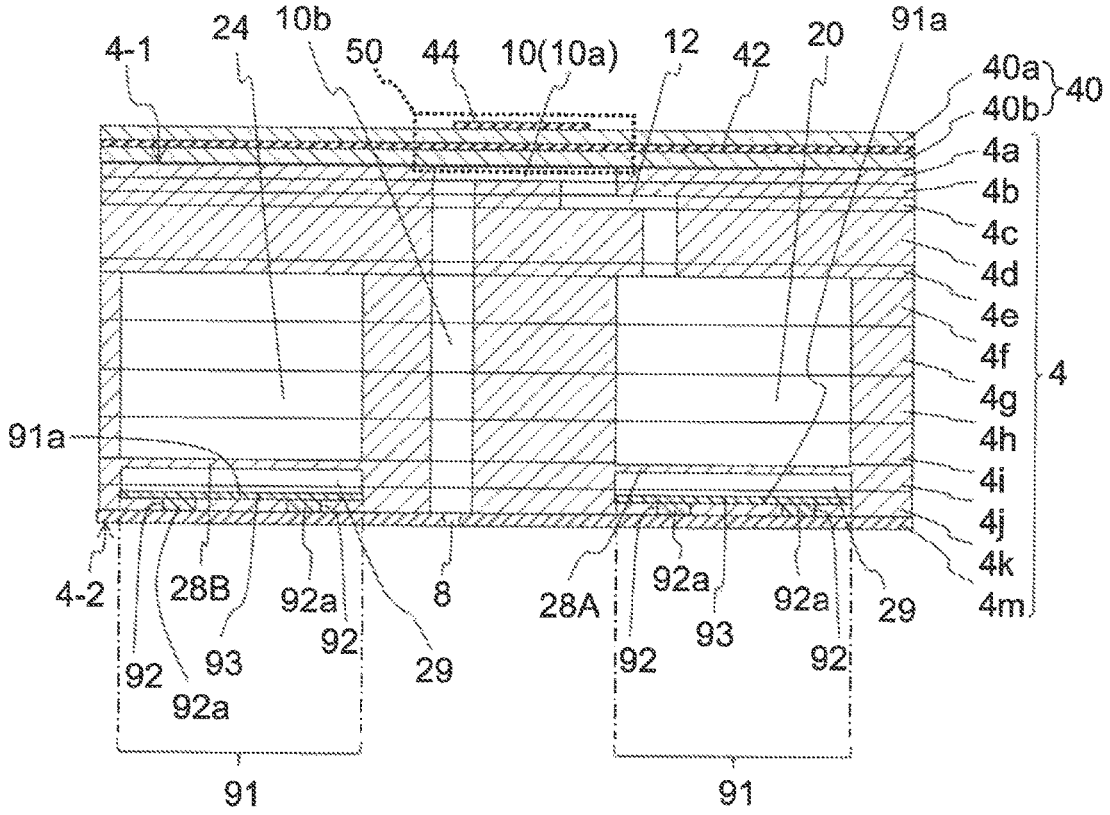
FIG. 10 is a schematic partial cross-sectional view showing the same state as that in FIG. 5 in the liquid ejection head in the third embodiment.

FIG. 9 is a schematic plan view showing the same state as FIG. 7 in a liquid ejection head in a third embodiment. FIG. 10 is a schematic partial cross-sectional view showing the same state as FIG. 5 in the liquid ejection head of the third embodiment. Note that, in the present embodiment, the explanation will be given of the points different from the first embodiment explained before, the same components will be assigned the same notations, and overlapping explanations will be omitted.

In the present embodiment, as shown in FIG. 9 and FIG. 10, a plurality of through holes 92 are provided of the first parts 91 in the second plate 4*k*, a filling material 92*a* is provided inside the plurality of through holes 92, and the material configuring the filling material 92*a* is made different from the material configuring the second plate 4*k*. Due to this, the unevenness in the mass and rigidity is raised in the integrally vibrating composite bodies configured by the first parts 91, covering layer 93, and filling material 92*a* and it becomes possible to make the structural symmetry further lower, therefore the effect of reduction of large vibration at a specific frequency can be further raised.

As the material configuring the filling material 92*a*, use can be made of a metal, resin, glass, or various other known materials.

When using a resin as the material configuring the filling material 92*a*, for example, it is possible to fill an uncured resin which becomes the filling material 92*a* in the through holes 92, then heat and cure it to form the filling material 92*a*. Note that, for example, by making the thickness of coating of the adhesive for bonding the first plate 4*m* and the second plate 4*k* thicker than usual and adjusting the pressure which is applied after pasting the first plate 4*m* and the second plate 4*k* together, an adhesive which becomes low in viscosity may be filled inside the through holes 92 and be cured to form the filling material 92*a*. Further, for example, by controlling the thickness of coating of the adhesive for bonding the first plate 4*m* and the second plate 4*k* to ½ or more of the thickness of the second plate 4*k* and adjusting the pressure which is applied after pasting the first plate 4*m* and the second plate 4*k* together, an adhesive which becomes low in viscosity may be filled inside the through holes 92 and be made to ooze out onto the surface on the plate 4*j* side in the second plate 4*k* and cured to thereby configuring the covering layer 93 together with the filling material 92*a*. By integrally forming the covering layer 93 and the filling material 92*a* by using the same material in this way, it is possible to simplify the manufacturing processes and facilitate manufacture.

Further, as shown in FIG. 9, desirably the pluralities of through holes 92 are unevenly arranged in the first parts 91. Due to this, the structural symmetry can be lowered, therefore it is possible to reduce degradation of ejection characteristics due to generation of large vibration caused by the resonance phenomena in the parts sandwiched between the ejection hole surface 4-2 and the damper chambers 29. Note that, "the through holes 92 are unevenly arranged" means that the densities of the through holes 92 in the first parts 91 are not constant, that is, there are parts in which the through holes 92 are densely arranged and parts in which the through holes 92 are sparsely arranged.

Further, as shown in FIG. 9 and FIG. 10, pluralities of ejection holes 8 are arranged so as to form a plurality of columns. Further, the first parts 91 are arranged between the columns and have shapes long in a first direction of the direction along the columns. Further, a plurality of through hole groups which are configured by arranging pluralities of through holes 92 close to each other are arranged along the first direction so that they are spaced apart from each other. Due to such configuration, large vibration caused by the resonance phenomena can be reduced over the entire first parts 91 which are long in the first direction. Note that, in the present embodiment, as shown in FIG. 9, one through hole group is configured by four through holes 92, and a plurality of through hole groups which are configured in this way are arranged along the first direction as the length direction of the first parts 91 so that they are spaced apart from each other.

Further, in the present embodiment, the conditions may be set so that the linear expansion coefficient of the material configuring the first plate 4*m* is larger than the linear expansion coefficient of the material configuring the second plate 4*k* and the linear expansion coefficient of the material configuring the filling material 92*a* is larger than the linear expansion coefficient of the material configuring the second plate 4*k*. Due to this, when the adhesive for bonding the first plate 4*m* and the second plate 4*k* is cured by heating and the temperature is returned to ordinary temperature, the first plate 4*m* and the filling material 92*a* contract larger than the second plate 4*k*. Due to this, it is possible to cause deformation so that the parts in the ejection hole surface 4-2 which are adjacent to the damper chambers 29 become slightly recessed portions and it is possible to prevent the recess amounts in the recessed portions from being excessively large. Due to this, it is possible to prevent the portions having the ejection holes 8 formed therein in the ejection hole surface 4-2 from being relatively recessed. Therefore, occurrence of the problem that unwiped portions are formed in the vicinities of the ejection holes 8 can be reduced. Further, it is possible to prevent the formation of the unwiped portions at parts in the ejection hole surface 4-2 adjacent to the damper chambers 29 due to the amounts of recess of the portions adjacent to the damper chambers 29 in the ejection hole surface 4-2 becoming excessively large.

At this time, the specific material for configuring the filling material 92*a* can be suitably selected from among various known materials so as to satisfy the condition of linear expansion coefficient. For example, when selecting a stainless steel alloy or carbon steel as the material of the plates 4*a* to 4*k* including the second plate 4*k*, as the material of the filling material 92*a*, preferably use can be made of a metal such as nickel, tin, lead, or the like or a resin such as a polyimide or epoxy resin.

Further, when using tin or another metal having a low melting point as the material for configuring the filling material 92*a*, for example, it is possible to stack the first plate 4*m* and the second plate 4*k*, then fill a powdery or granular metal in the through holes 92, use the heat when curing the adhesive for bonding the first plate 4*m* and the second plate 4*k* to melt the powdery or granular metal, then returned it to ordinary temperature to thereby configure the filling material 92*a*.

Further, although illustration is omitted, in the surface on opposite side to the first plate 4*m* in the filling material 92*a*, the parts located at the centers of the through holes 92 when viewed on a plane are desirably recessed to the first plate 4*m* side. Due to this, along the surface on the opposite side to the first plate 4*m* in the filling material 92*a*, stress pulling toward the centers of the through holes 92 is generated in the second plate 4*k*, therefore it is possible to raise the effect of preventing the recess amounts of the parts in the ejection hole surface 4-2 which are adjacent to the damper chambers 29 from being excessively large.

Fourth Embodiment

Figure 11:
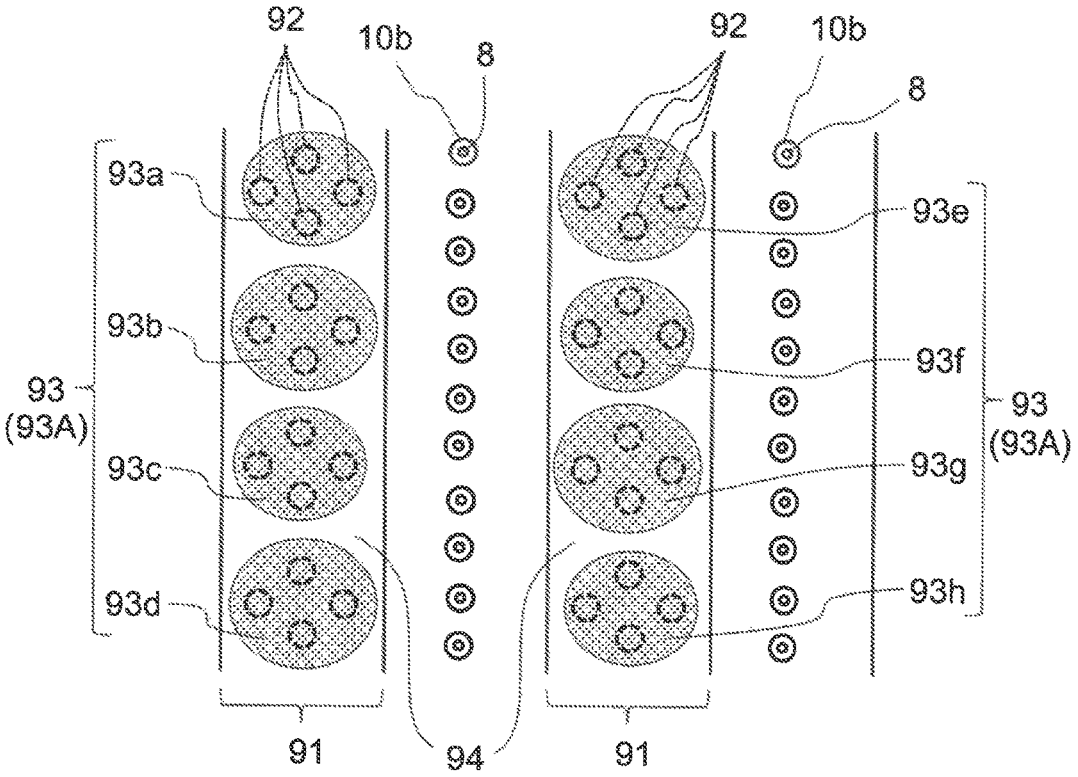
FIG. 11 is a schematic plan view showing the same state as that in FIG. 9 in a liquid ejection head in a fourth embodiment.

FIG. 11 is a schematic plan view showing the same state as FIG. 9 in the liquid ejection head in a fourth embodiment. Note that, in the present embodiment, the explanation will be given of the points different from the third embodiment explained before, the same components will be assigned the same notations, and overlapping explanations will be omitted.

In the present embodiment, the covering layer 93 is arranged divided into a plurality of regions. That is, as shown in FIG. 11, the first regions 93A provided with the covering layer 93 are divided into a plurality of regions (93*a*, 93*b*, 93*c*, 93*d*, 93*e*, 93*f*, 93*g*, 93*h*). Also the liquid ejection head in the present embodiment having such structure, in the same way as the third embodiment explained before, has the unevenly provided covering layer 93 and through holes 92. Therefore, it is possible to reduce large vibration of the parts sandwiched by the ejection hole surface 4-2 and the damper chambers 29 at a specific frequency.

Further, at this time, desirably the areas of the regions adjacent to each other among the plurality of regions in the covering layer 93 are made different from each other. That is, as shown in FIG. 11, desirably the areas are set so that the area of the region 93*a* and the area of the region 93*b* are different, the area of the region 93*b* and the area of the region 93*c* are different, the area of the region 93*c* and the area of the region 93*d* are different, the area of the region 93*e* and the area of the region 93*f* are different, the area of the region 93*f* and the area of the region 93*g* are different, and the area of the region 93*g* and the area of the region 93*h* are different. Due to this, the structural symmetry can be further lowered, therefore it is possible to further reduce degradation of ejection characteristics due to generation of large vibration caused by the resonance phenomena in the parts sandwiched between the ejection hole surface 4-2 and the damper chambers 29.

Fifth Embodiment

Figure 12:
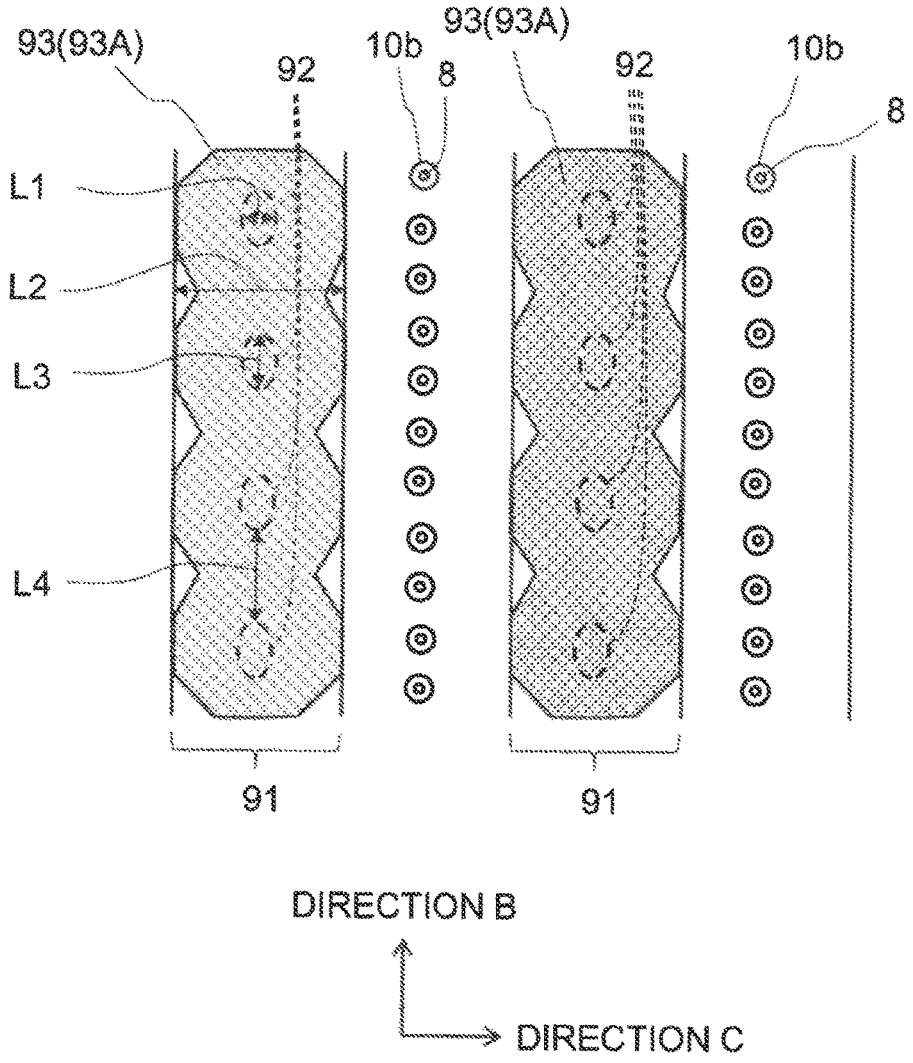
FIG. 12 is a schematic plan view showing the same state as that in FIG. 9 in a liquid ejection head in a fifth embodiment.

FIG. 12 is a schematic plan view showing the same state as FIG. 9 in the liquid ejection head in a fifth embodiment. Note that, in the present embodiment, the explanation will be given of the points different from the third embodiment explained before, the same components will be assigned the same notations, and overlapping explanations will be omitted.

In the present embodiment, the plurality of through holes 92 do not configure any through hole groups and through holes 92 larger than the through holes 92 in the third embodiment are aligned along the first direction. That is, when the two directions which are perpendicular to each other are the B direction (first direction) and C direction, the dimension in the B direction of the first part 91 is larger than the dimension in the C direction of the first part 91 (the length of the portion indicated by L2 in FIG. 12), and the plurality of through holes 92 are aligned along the B direction. Even according to such a structure, it is possible to reduce large vibration of the parts sandwiched by the ejection hole surface 4-2 and the damper chambers 29 at a specific frequency.

In the present embodiment, the rigidity and mass distribution in the composite bodies of the first parts 91 and covering layer 93 are made uneven by the through holes 92. The structural symmetry of the composite bodies can be lowered by this. Further, due to this, the degeneracy of resonance mode is removed and the resonance frequency can be dispersed, therefore it is possible to reduce large vibration of the composite body of the first parts 91 and covering layer 93 at a specific frequency. Accordingly, the through holes 92 are preferably large to a certain extent. Further, the asymmetry in the shape of the through holes 92 is preferably large.

Accordingly, for example, when the dimension in the C direction of the first parts 91 (length of the portion indicated by L2 in FIG. 12) is defined as D and the dimension in the C direction of the through holes 92 (length of the portion indicated by L1 in FIG. 12) is defined as E, preferably they are adjusted to an extent satisfying $E/D \geq 0.22$. Further preferably, they are adjusted to an extent satisfying $E/D \geq 0.25$ or $E/D \geq 0.30$.

Further, for example, when the dimension in the B direction of the through holes 92 (length of the portion indicated by L3 in FIG. 12) is defined as F and the interval between the adjoining through holes 92 in the B direction (length of the portion indicated by L4 in FIG. 12) is defined as G, preferably they are adjusted to an extent satisfying $F/G \geq 0.79$. Further preferably, they are adjusted to an extent satisfying $F/G \geq 0.88$ or $F/G \geq 1.06$.

Further, for example, when the dimension in the B direction of the through holes 92 (length of the portion indicated by L3 in FIG. 12) is defined as H and the dimension in the C direction of the through holes 92 (length of the portion indicated by L1 in FIG. 12) is defined as J, preferably they are adjusted to an extent satisfying $H/J \geq 1.60$. Further preferably, they are adjusted to an extent satisfying $H/J \geq 1.80$ or $H/J \geq 2.20$.

Further, FIG. 12 shows an example in which each through hole 92 is shaped as a circle elongated in the B direction and a plurality of through holes 92 having the same shape and size are arranged at the center in the B direction of the first parts 91 at equal intervals along the C direction, but the through holes 92 are not limited to this. The shapes and sizes of the plurality of through holes 92 may be made different from each other, the plurality of through holes 92 may be arranged with offset from the center of the B direction of the first parts 91, and the intervals of the adjoining through holes 92 may be made different according to the location. Further, the desirable relationships between dimensions related to the through holes 92 explained above do not always have to be satisfied among all through holes 92.

REFERENCE SIGNS LIST

1 . . . color inkjet printer
2 . . . liquid ejection head
  2*a* . . . head body
4 . . . first channel member (channel member)
  4*m* . . . first plate
  4*k* . . . second plate
  4*a* to 4*j* . . . plates (of first channel member)
  4-1 . . . pressurizing chamber surface
  4-2 . . . ejection hole surface
6 . . . second channel member
  6*a*, 6*b* . . . plates (of second channel member)
  6*c* . . . through hole (of second channel member)
  6*ca* . . . widened part of through hole
8 . . . ejection hole
9A . . . ejection hole column
9B . . . ejection hole row
10 . . . pressurizing chamber
  10*a* . . . pressurizing chamber body
  10*b* . . . partial channel (descender)
10D . . . dummy pressurizing chamber
11A . . . pressurizing chamber column
11B . . . pressurizing chamber row
12 . . . first individual channel
14 . . . second individual channel
20 . . . first common channel (common channel)
  20*a* . . . opening (of first common channel)
22 . . . first integrating channel
  22*a* . . . first integrating channel body (first groove)
  22*c* . . . opening (of first integrating channel)
24 . . . second common channel (common channel)
  24*a* . . . opening (of second common channel)
25A, 125A . . . first connection channels
25B . . . second connection channel
26 . . . second integrating channel
  26*a* . . . second integrating channel body (second groove)
  26*c* . . . opening (of second integrating channel)
28A . . . first damper
28B . . . second damper
29 . . . damper chamber
30 . . . end part channel
  30*a* . . . broad portion

30*b* . . . narrowed portion
30*c*, 30*d* . . . openings (of end part channels)
40 . . . piezoelectric actuator substrate
40*a* . . . piezoelectric ceramic layer
40*b* . . . piezoelectric ceramic layer (vibration plate)
42 . . . common channel
44 . . . individual electrode
44*a* . . . individual electrode body
44*b* . . . lead out electrode
46 . . . connection electrode
50 . . . pressurizing part
60 . . . signal transmission part
70 . . . head mounting frame
72 . . . head group
80A . . . paper feed roller
80B . . . collection roller
82A . . . guide roller
82B . . . conveying roller
88 . . . control part
91 . . . first part
92 . . . through hole
92*a* . . . filling material
93 . . . covering layer
93A . . . first region
94 . . . second region
P . . . printing paper

The invention claimed is:

1. A liquid ejection head comprising:
a channel member comprising:
a plurality of ejection holes ejecting liquid;
a common channel linked with the plurality of ejection holes;
a damper chamber configured by a space outside of the common channel; and
a damper configured by a wall partitioning the common channel and the damper chamber; and
a plurality of pressurizing parts for pressurizing the liquid, wherein
the channel member is configured by a stacked plurality of flat plates,
the plurality of plates comprises
a first plate comprising the plurality of ejection holes and
a second plate adjacent to the first plate,
the second plate comprises a first part sandwiched by the first plate and the damper chamber,
the first part comprises a first surface on opposite side from the first plate, and
the liquid ejection head comprises a covering layer which is unevenly provided on the first surface of the first part.

2. The liquid ejection head according to claim 1, wherein the first surface comprises a first region which is covered with the covering layer and a second region which is not covered with the covering layer.

3. The liquid ejection head according to claim 1, wherein the covering layer is divided into a plurality of regions.

4. The liquid ejection head according to claim 3, wherein, among the plurality of regions in the covering layer, areas of the regions which are adjacent to each other are different from each other.

5. The liquid ejection head according to claim 1, wherein:
the plurality of ejection holes form a plurality of columns,
the first part is located between the columns and has a longitudinal direction corresponds to a first direction along the columns, and
the covering layer has a longitudinal direction corresponds to the first direction and is shaped with broad width parts and narrow width parts alternately arranged along the first direction.

6. The liquid ejection head according to claim 5, wherein the widths of the narrow width parts which are adjacent to each other are different from each other.

7. The liquid ejection head according to claim 1, wherein:
the second plate comprises a plurality of through holes at the first part,
the liquid ejection head comprises filling materials provided inside the plurality of through holes, and
a material configuring the filling material is different from a material configuring the second plate.

8. The liquid ejection head according to claim 7, wherein the covering layer and the filling material are integrally formed of one material.

9. The liquid ejection head according to claim 7, wherein a linear expansion coefficient of a material configuring the first plate is larger than a linear expansion coefficient of the material configuring the second plate, and a linear expansion coefficient of the material configuring the filling material is larger than the linear expansion coefficient of the material configuring the second plate.

10. The liquid ejection head according to claim 7, wherein a dimension in a B-direction of the first part is larger than a dimension in a C-direction of the first part, and the plurality of through holes are aligned along the B-direction, where two directions perpendicular to each other are the B-direction and C-direction.

11. The liquid ejection head according to claim 10, wherein $E/D \geq 0.22$ stands, where the dimension in the C-direction of the first part is D and a dimension in the C-direction of the through holes is E.

12. The liquid ejection head according to claim 10, wherein $F/G \geq 0.79$ stands, where a dimension in the B-direction of the through holes is F and the interval between the through holes adjacent to each other in the B-direction is G.

13. The liquid ejection head according to claim 10, wherein $H/J \geq 1.60$ stands, where the dimension in the B-direction of the through holes is H and the dimension in the C-direction of the through holes is J.

14. The liquid ejection head according to claim 1, wherein a linear expansion coefficient of a material configuring the first plate and a linear expansion coefficient of a material configuring the covering layer are larger than a linear expansion coefficient of a material configuring the second plate.

15. A recording device comprising:
a liquid ejection head according to claim 1;
a conveying part which carries a recording medium with respect to the liquid ejection head; and
a control part which controls the liquid ejection head.

* * * * *